US011412868B2

(12) United States Patent
Haggar

(10) Patent No.: US 11,412,868 B2
(45) Date of Patent: Aug. 16, 2022

(54) TRI-FACE DISPLAY DEVICE AND SYSTEM FOR GENERATING IMAGES FOR SAME AND A CLAMSHELL FOR A FRAME

(71) Applicant: GAME DEV CORP., Coral Springs, FL (US)

(72) Inventor: Frank Haggar, Coral Springs, FL (US)

( * ) Notice: Subject to any disclaimer, the term of this patent is extended or adjusted under 35 U.S.C. 154(b) by 0 days.

(21) Appl. No.: 17/085,515

(22) Filed: Oct. 30, 2020

(65) Prior Publication Data

US 2021/0045551 A1 Feb. 18, 2021

Related U.S. Application Data

(63) Continuation-in-part of application No. 16/192,720, filed on Nov. 15, 2018, now Pat. No. 11,302,224.

(51) Int. Cl.
*A47G 1/06* (2006.01)
*A47G 1/12* (2006.01)

(52) U.S. Cl.
CPC ..... *A47G 1/12* (2013.01); *A47G 1/06* (2013.01)

(58) Field of Classification Search
CPC . A47G 1/12; A47G 1/06; A47G 1/065; A47G 1/0616; G09F 19/14; B44F 7/00; B65D 73/0057; B65D 73/0092; B65D 73/0042; B65D 73/0085
USPC ..... 206/461–465
See application file for complete search history.

(56) References Cited

U.S. PATENT DOCUMENTS 3,062,366 A * 11/1962 Palmer ..... B65D 73/0092 206/443
5,057,344 A * 10/1991 Mealey ..... A47G 1/0616 428/912.2
6,023,866 A 2/2000 Polsky
10,888,181 B1 * 1/2021 Williams ..... A47G 1/0616
2002/0189964 A1 * 12/2002 Mazurek ..... B65D 5/4204 206/467

FOREIGN PATENT DOCUMENTS

EP 1449679 8/2004
WO WO-2009134121 A1 * 11/2009 ..... A47G 1/12

* cited by examiner

*Primary Examiner* — Cassandra Davis
(74) *Attorney, Agent, or Firm* — Sanchelima & Associates, P.A.; Christian Sanchelima; Jesus Sanchelima

(57) ABSTRACT

A tri-face artwork display device that allows for three different views within the same frame. One embodiment includes upper and lower rows of corresponding slits on the top and bottom of the frame. The slits have a predetermined depth so as to not penetrate through the other side of the frame. The slits hold the image panels that display the second and third image to compliment the first image. The image panel has a second image on its first face and a third image on its second face. Additionally, a clamshell provides enhanced depth to contents inserted within a frame. The clamshell includes a box assembly with sidewalls and a flap assembly that is insertable within a rabbet of a frame.

9 Claims, 27 Drawing Sheets

TRI-FACE DISPLAY DEVICE AND SYSTEM FOR GENERATING IMAGES FOR SAME AND A CLAMSHELL FOR A FRAME

OTHER RELATED APPLICATIONS

The present application is a continuation-in-part of pending U.S. patent application Ser. No. 16/192,720, filed on Nov. 15, 2018, which is hereby incorporated by reference.

BACKGROUND OF THE INVENTION

1. Field of the Invention

The present invention relates to tri-face artwork display and simulator software, and more particularly such a display that includes a fillet assembly to mount a plurality of image panels thereon and a trifold simulator software that loads three images to generate one trifold image. The present invention also relates to a framing system mountable to an existing frame.

2. Description of the Related Art

Several alternative designs for tri-faced image displays have been created in the past including U.S. Pat. No. 6,023,866A (the "Polsky Patent") and EU Patent 1,449,679 (the "Kmoth Patent" a.k.a. the "Vom Blickwinkel Patent").

The first reference, the Polsky Patent, teaches a "triple-view picture kit" and discloses a toy that "allows the user to place panel [strip-like picture elements] in a staggered array so that different pictures are seen from different angles." The Polsky Patent discloses a frame with top and bottom slits for the vertical pictures to be inserted. These strip-like picture elements can be attached together in a sheet to be colored or drawn on. Where after they are separated and subsequently mounted in a sequential order inside the slits of a box frame. Unlike the box frame in Polsky, the frame in the present invention is not folded. Rather it is sturdy and rigid providing a better fit and support for the inserts.

The Vom Blickwinkel Patent creates vertical slits within the base of an element used to insert pictures to create one continuous free-flowing image. None of the prior arts create a fillet assembly containing two complimentary rows of receiving cavities along the top and bottom, slits that have a predetermined depth that stop short of penetrating through the frame, an adaptor that is inserted into the slits or the fillet assembly, a fillet having a locking flange to fit under a matting of a frame to secure the fillet to the frame, or an interlocking fillet design that allows the user to adjust the length of the fillet to fit in various sizes of picture frames and mattings.

The present invention may use a fillet assembly to secure the picture, as opposed to Vom Blickwinkel which only uses slits within the base element. Also, Vom Blickwinkel is more of a free-flowing picture unlike the present invention that has a plurality of slits adapted to receive a variety of different sized picture elements.

One of the differences in the present invention is that it offers a way to retrofit standard picture frames. The fillet assembly can retrofit existing pictures frame by using the fillets on two opposite side walls. The Vom Blickwinkel reference consists of receiving cavities that go along the bottom of the frame, instead of vertically. The present invention uses receiving cavities defined by two opposite side walls to secure the picture and increase structural integrity, as opposed to Vom Blickwinkel that only uses slits on one side wall on the bottom of the base element.

In contrast to the Polsky reference, which has slits along the top and the bottom base element that go all the way through the frame, the present invention offers a frame with slits that stop short of penetrating through the frame. These slits offer a side support structure that secures the frames in place and keep them from bending. Additionally, the adapter element that fits inside the fillet and/or slits to better hold the vertical picture elements is not anticipated by the prior art.

SUMMARY OF THE INVENTION

It is one of the objects of the present invention to provide a way to retrofit standard picture frames with fillets to fit with three diagonal pictures so that each photo is visible from a different angle.

It is another object of the present invention is to provide a trifold simulator software. The software allows the user to select or specify frame size, number of slats, edge and fill colors to be used in frames with fillets. The software allows the user to upload three images to generate one trifold image.

It is another object of the present invention is to provide a cropping tool in the software to fit the slats or to fit the back-image size. The cropping tool allows user to select in the image portion that should be used for slats or back image.

It is yet another object of the present invention to provide a framing system mountable to an existing frame which adds additional content depth when mounted thereon.

It is yet another object of the present invention to provide a framing system which allows content within a frame to be viewed from multiple sides and angles as opposed to the single head-on vantage point provided by a traditional shadow box.

Further objects of the invention will be brought out in the following part of the specification, wherein the detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

Figure 1:
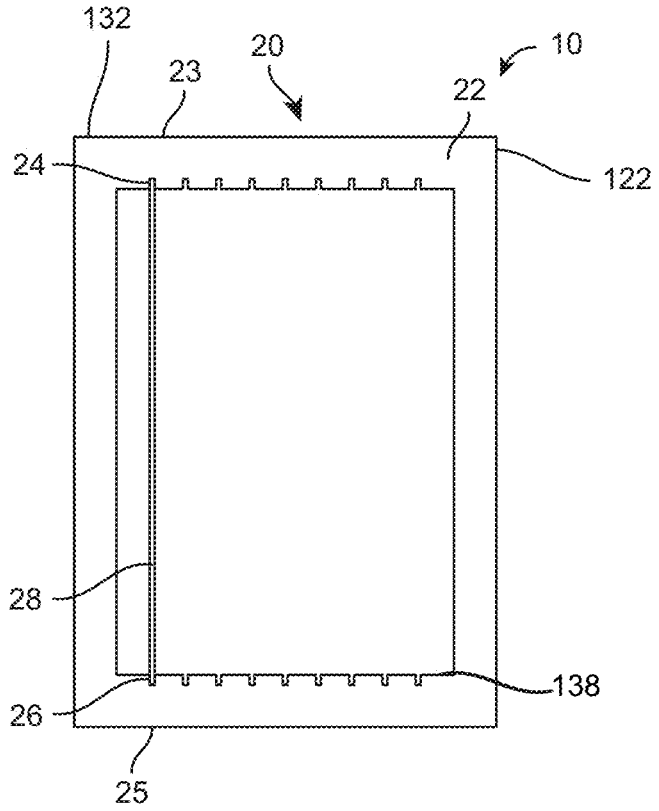
FIG. 1 is a front view of one of the embodiments of the present invention, showing a tri-faced image display 10 comprising a frame assembly 20 with upper slits 24 and lower slits 26 on a frame 22.

Referring now to the drawings where the present invention is generally referred to with numeral 10, it can be observed a tri-faced image display 10 which basically includes a frame assembly 20 and a fillet assembly 40.

FIG. 1 is a front view of one of the embodiments of the present invention, showing a tri-faced image display 10 comprising a frame assembly 20 with upper slits 24 and lower slits 26 on a frame 22. A frame assembly 20 has a frame 22 of squared shape and four borders having a certain thickness to maintain a squared shape along the edges of the frame 22 with a top side 23, a bottom side 25, a top distal end 132 and a bottom distal end 122. A plurality of the upper slits 24 and the lower slits 26 are located along the length of the inner portion of the top side 23 and the bottom side 25 of the frame 22. The upper slits 24 and the lower slits 26 are visible when looking at the frame 22 from the front, in a way that vertical picture objects can be inserted through the front of the frame 22. The first image is held inside the frame 22, a second image is portrayed on the first side of the image panel 28, and a third image is portrayed on the second side of the image panel 28. A plurality of the image panels 28 are held in a vertical position with respect to the upper slits 24 and the lower slits 26 in a way that three pictures are visible by the looking at the frame 22 from different angles. The spacing of the upper slits 24 and the lower slits 26 can vary to control the viewing angle. With the slits spaced at a one slit per one inch of fillet the viewer needs to view the frame from a greater viewing angle to see the complete image. However, when the slits are spaced closer together, the viewer can view from a more front facing viewing angle position to see the complete image.

The bottom side 25 has a bottom front face 124 and a bottom side upper surface 138, creating a squared shape along the edges of the frame 22. A plurality of the lower slits 26 are located along the length of the bottom side upper surface 138. The lower slits 26 extend vertically with respect to the bottom side upper surface 138 from the bottom front face 124 to a bottom rear face 128.

The upper slits 24 and the lower slits 26 are visible when looking at the frame 22 from the front, in a way that vertical picture objects can be inserted through the front of the frame 22. The first image is held inside the frame 22, a second image is portrayed on the first side of the image panel 28, and a third image is portrayed on the second side of the image panel 28. A plurality of the image panels 28 are held in a vertical position with respect to the upper slits 24 and the lower slits 26 in a way that three pictures are visible by the looking at the frame 22 from different angles.

Figure 1A:
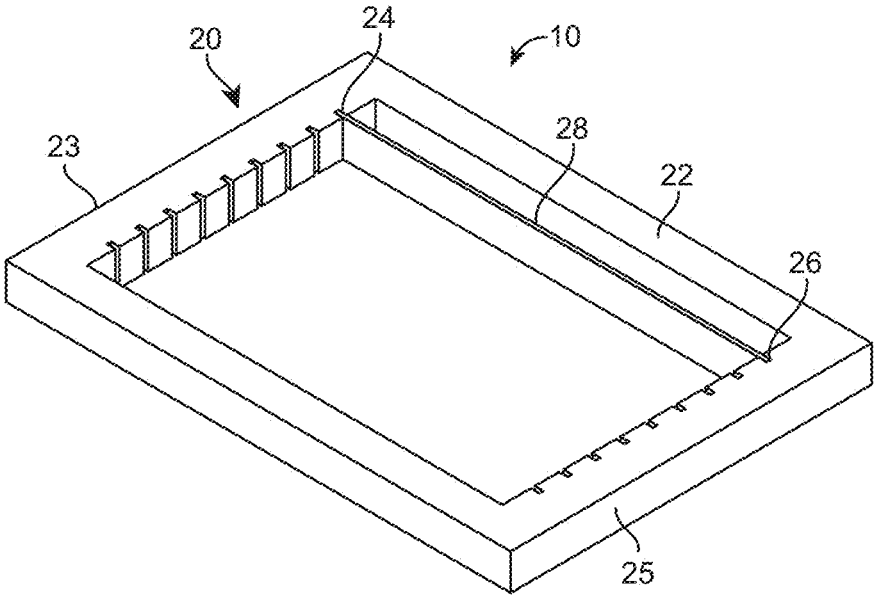
FIG. 1A is a left isometric view of an embodiment of tri-faced image display 10 in accordance to an embodiment of the present invention.

FIG. 1A shows the top rear face 126 and the bottom rear face 128. The upper slits 24 extent to the top rear face 126 and the lower slits 26 extend to the bottom rear face 128.

Figure 1B:
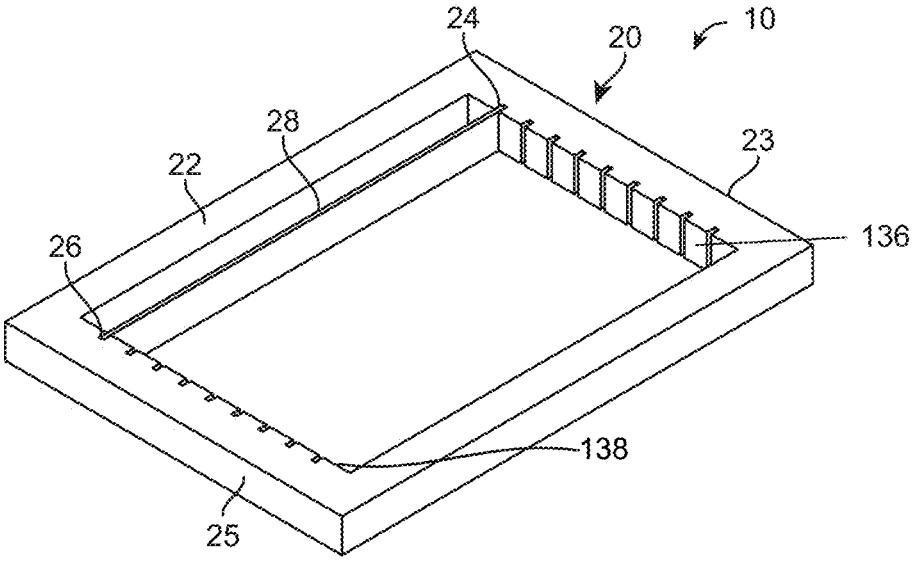
FIG. 1B is a right isometric view of an embodiment of tri-faced image display 10 in accordance to an embodiment of the present invention.

FIG. 1B shows the top side 23 having the top side lower surface 136. The upper slits 24 are located along the length of the top side lower surface 138. The upper slits 24 have a predetermined depth that allows for the image panel 28 to be inserted into the upper slits 24. The bottom side 25 likewise, has the lower slits 26 located along the length of the bottom side upper surface 138 where the image panel 28 is inserted.

Figure 2:
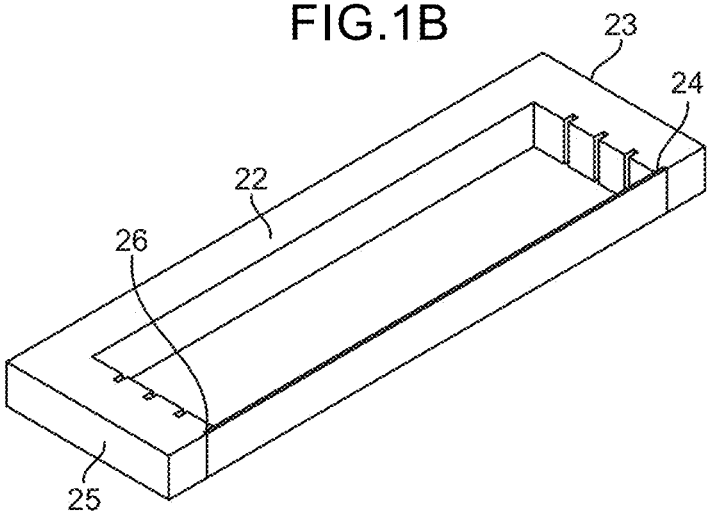
FIG. 2 is a cross-sectional view of the frame 22 shown in FIG. 1 revealing the depth of the upper slits 24 and the lower slits 26 within top side 23 and bottom side 25 respectively.

FIG. 2 shows the depth of the upper slits 24 and the lower slits 26 stopping short of penetrating through the top side 23 and the bottom side 25 respectively. The depth of the upper slits 24 and the lower slits 26 may be increased by adding material blocks, or "build-ups" to the spaces between both upper slits 24 and lower slits 26. The build-ups may be stacked to create a more desired slit depth. The build-ups can be made of a variety of materials including rubber, paper, cardboard, wood, plastic, or any other material capable of providing structure.

Figure 3:
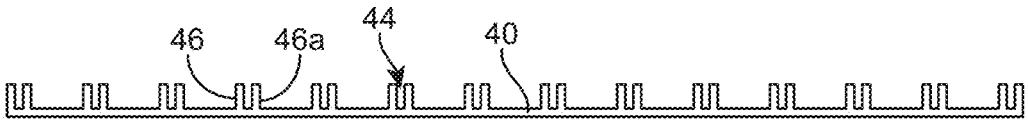
FIG. 3 is a front elevational view of an alternate embodiment of the present invention showing fillet assembly 40 having a plurality of receiving cavities 44 defined by side walls 46 and 46*a*.

FIG. 3 shows the fillet assembly 40 having a plurality of receiving cavities 44 having an interior space defined by side walls side walls 46 and 46*a*. The receiving cavities 44 maintain an interior space within each of the side walls 46 and 46*a* wherein the image panel 28 is inserted in a way that the image panel 28 is vertically held with respect to the fillet assembly 40. Side walls can be perpendicular or at an angle that applies compression to hold the slats in place.

Figure 4:
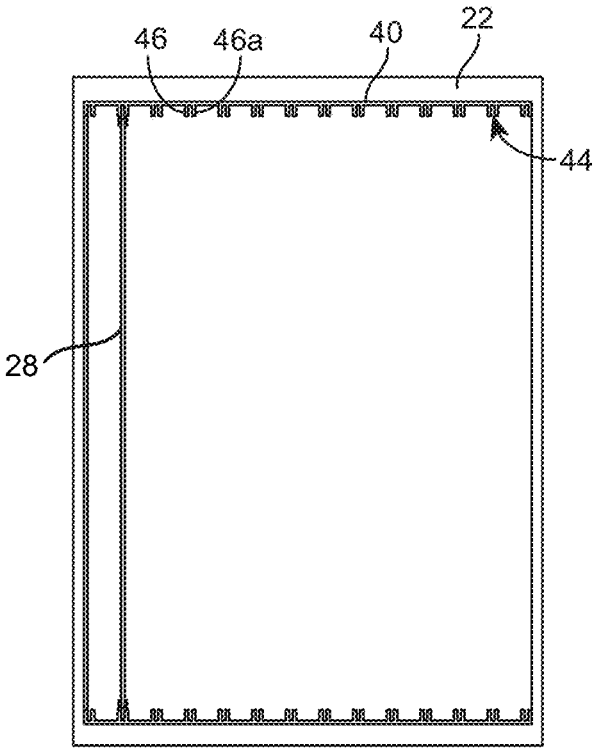
FIG. 4 is a front elevational view of the alternate embodiment showing the frame 22 retrofitted with the fillet assembly 40 to convert the single image display into a tri-faced image display.
Figure 4A:
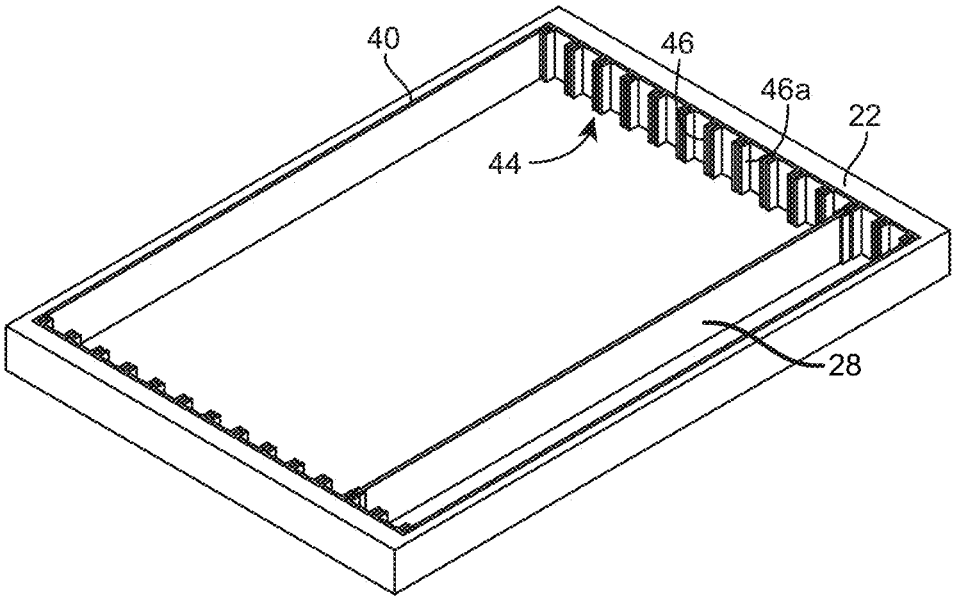
FIG. 4A is a left isometric view of the alternate embodiment with fillet assembly 40 shown in FIG. 3.
Figure 4B:
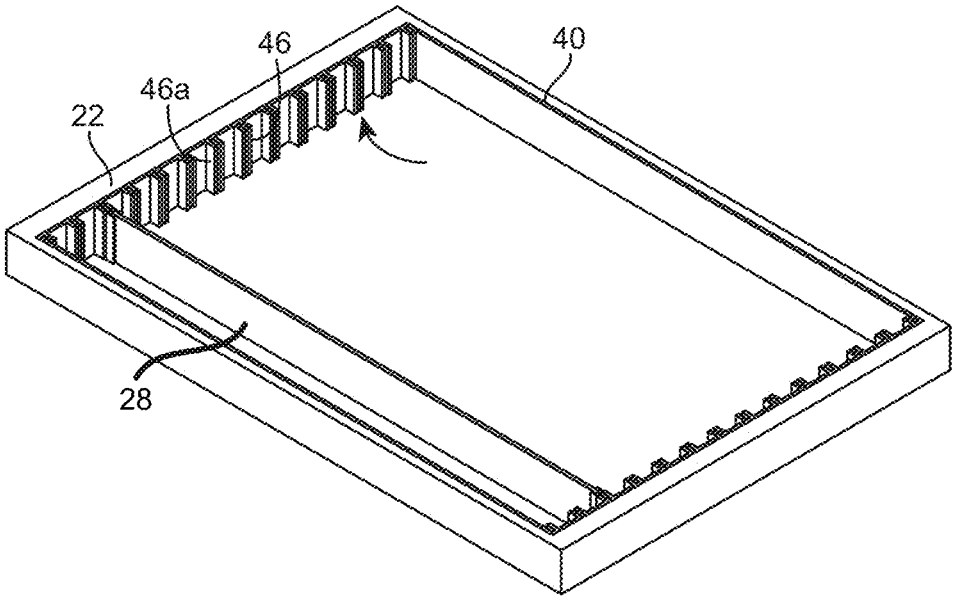
FIG. 4B is a right isometric view of the alternate embodiment with fillet assembly 40 shown in FIG. 3.

FIG. 4 shows the frame 22 retrofitted with the fillet assembly 40. FIG. 4A shows a plurality of the image panels 28 are inserted in the receiving cavities 44 in a way that three pictures are visible by the looking at the frame 22 retrofitted with the fillet assembly 40 from different angles. The fillets 40 may be rounded or angular. The fillets may also be made out of paper. The paper design contains perforations to allow the user to easily fold and assemble the fillet 40.

Figure 5:
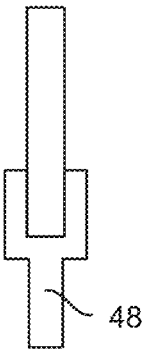
FIG. 5 is a front elevational view of the alternate embodiment shown in FIG. 4 having adapters 48.

FIG. 5 shows the fillet assembly 40 having the adapter 48. The adapter 48 has a bottom center wall having a distal end. The distal end is inserted into the receiving cavities 44 of the fillet assembly 40. The image panel 28 is inserted in the adapter receiving cavity of the adapter 48, in a way that the image panel 28 is vertically held with respect to the adapter receiving cavity of the adapter 48.

Figure 5A:
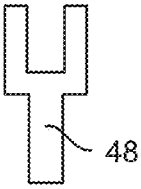
FIG. 5A is a front elevational view of the adapter 48.

FIG. 5A shows the adapter 48 having the adapter receiving cavity defined by an adapter first side wall, an adapter second side wall, and the bottom center wall. Adapter 48 allows for the adjustment of the receiving cavities 44 in the case that the image panel 28 has a smaller or larger thickness with respect to receiving cavities 44. The use of the adapter 48 thus allows fillet assembly 40 to hold different size image panels 28.

Figure 6:
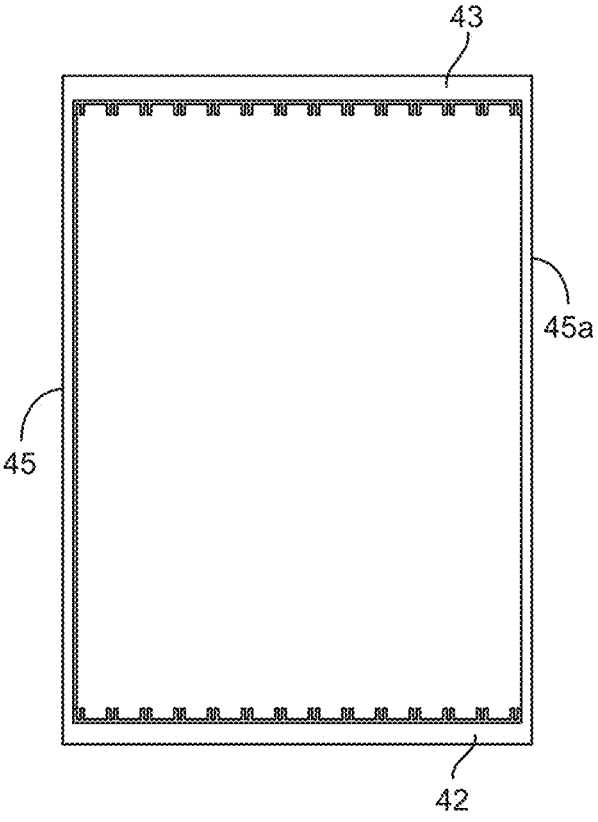
FIG. 6 is the fillet assembly 42 connected to a top fillet member 43 by side walls 45 and 45*a*.
Figure 7:
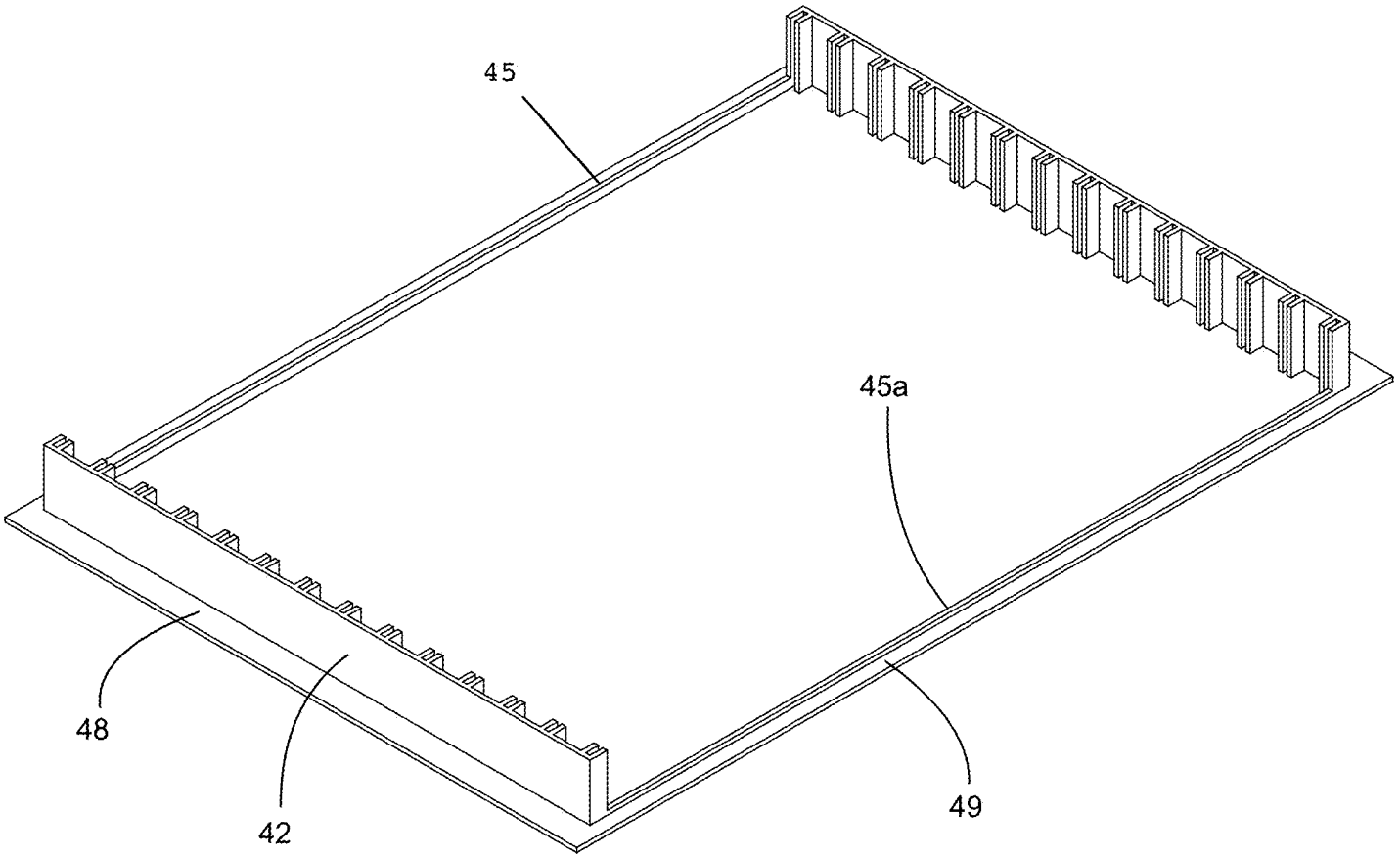
FIG. 7 is the fillet assembly 42 attached to side walls 45 and 45*a*.

FIG. 6 shows a fillet assembly 42 connected to a top fillet member 43 through the integration of the side walls 45 and 45*a*. The side walls 45 and 45*a* resemble a thin border made of a certain material that allows the side walls 45 and 45*a* to maintain a vertical direction with respect to the fillet assembly 42 and the top fillet member 43. The fillet assembly 42, the top fillet member 43, and the side walls 45 and 45*a* may be inserted into a picture frame or into the frame 22 in order to create a single image display into a tri-faced image display. FIG. 7 is the fillet assembly 42 attached to side walls 45 and 45*a*.

Figure 8:
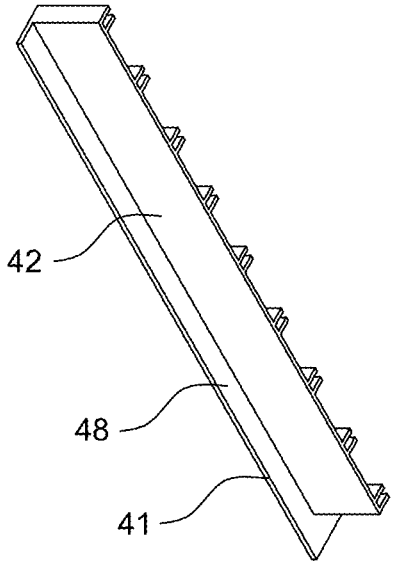
FIG. 8 is the fillet assembly 42 with attached locking flange 48.

FIG. 8 is the fillet assembly 42 with attached locking flange 48. The fillet assembly 42 has an attached locking flange 48 that extends perpendicularly from the surface of the fillet assembly 42 to fit under the matting of a frame. The sidewall 45*a* has an attached sidewall locking flange 49 that extends perpendicularly from the surface of the sidewall 45*a* to fit under the matting of the frame. The fillet locking flange 48 allows the insertion of the tri-faced image display into a frame being held down by the frame matting. Fillets without the locking flange 48 can be used in frames without mattings, such as shadow boxes. Fillet assembly 42 is a ninety-degree angle, L-shaped fillet having a solid back. It should be noted the fillet assembly can also have the interlocking base member. A part of the L shaped fillet goes behind the matting or frame opening and the other part of the L extends like a "shelf" into the frame opening. This gives the "shelf" the ability to hold the vertical walls that make the slits.

Figure 9:
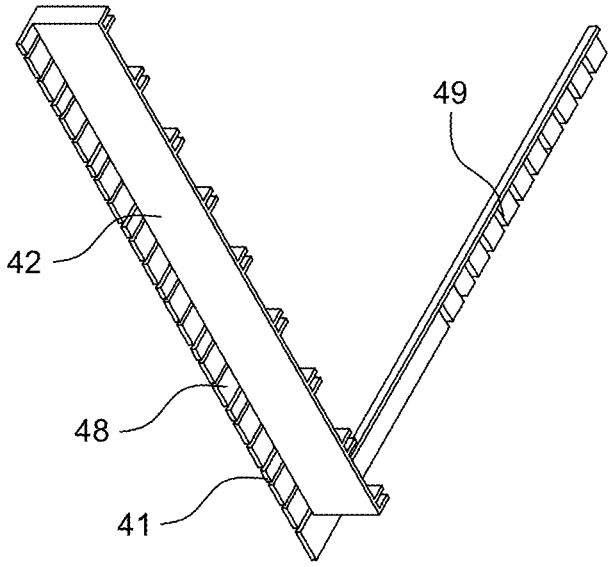
FIG. 9 is the breakaway fillet assembly 42 with attached locking flange 48 and 49.

FIG. 9 shows a fillet assembly 42 and an attached fillet locking flanges 48 and 49 that has an array of slots 41 that allow the user to interlock parts of the fillet assembly 42 to create a custom sized tri-faced image display. Fillet assembly 42 is a ninety-degree L shaped fillet with an interlocking design in the back. This allows users to easily adjust fillets to fit the frame or matting.

Figure 10:
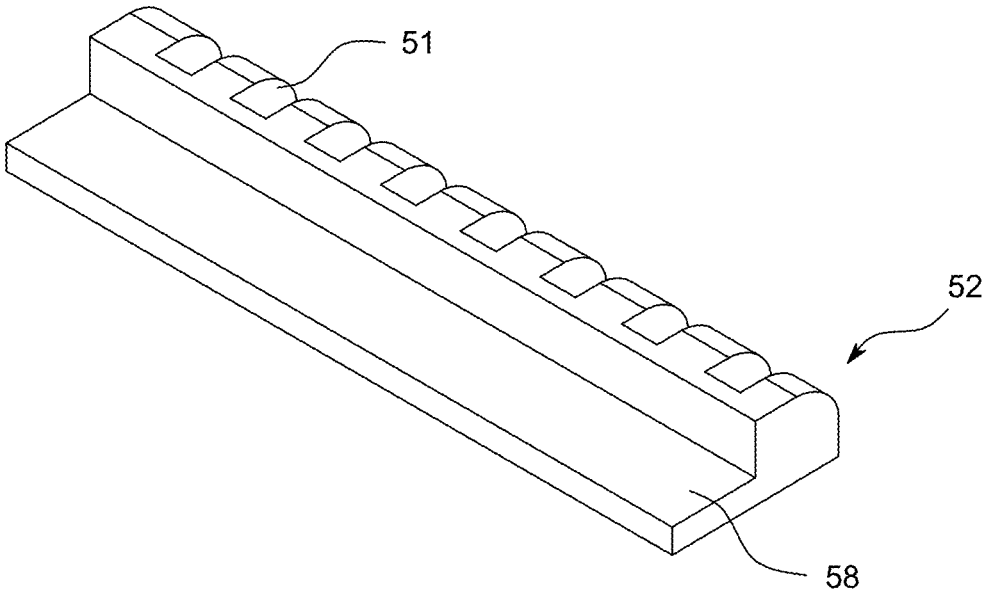
FIG. 10 is the rounded fillet assembly 52 with attached locking flange 58.

FIG. 10 shows a typical rounded or otherwise shaped fillet 52 with a flange 58 that exists commercially for enhancing the look of matting, except there are slits 51 cut to hold the artwork. The round shape can be a variety of other shapes for fillets, including like the edge of a kitchen cabinet and the like. Slits 51 are cut into the fillet to hold the artwork. In one embodiment of the invention, the fillet assembly has vertical walls that are slanted in, so that more pressure can be applied to the artwork to hold it in place and allow flexibility for variations of the slat width.

Figure 11:
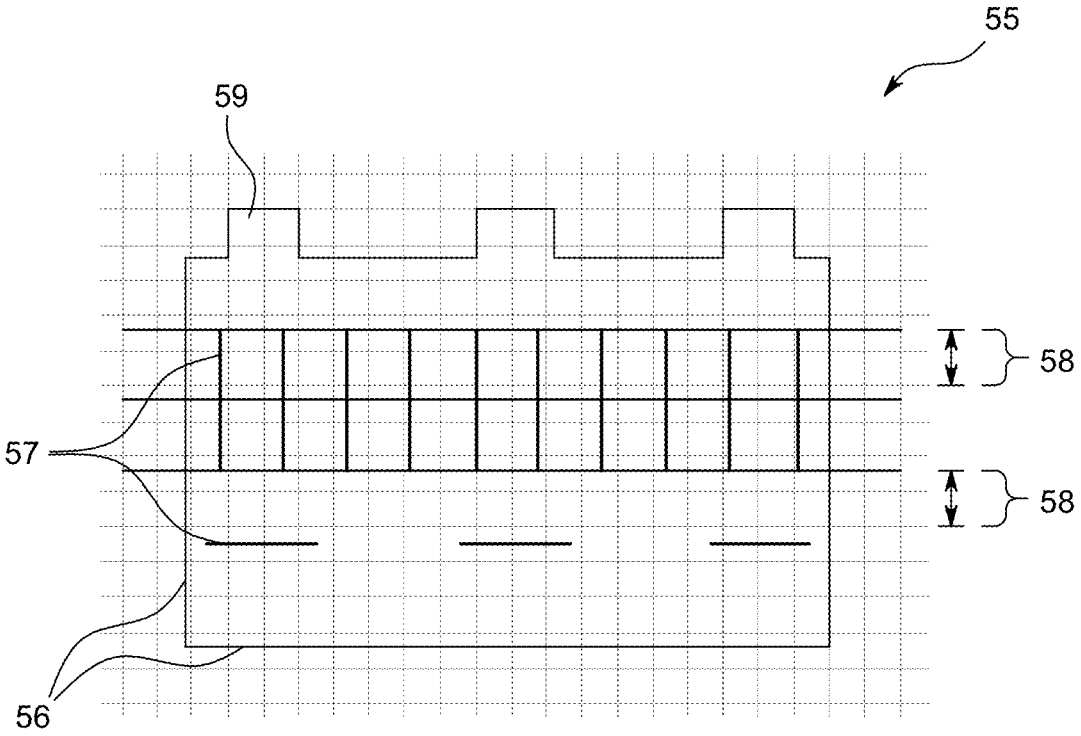
FIG. 11 shows a design 55 for the paper fillets with fold lines and cut lines.

FIG. 11 shows a design 55 for the paper fillets. The lines 56 are cut lines, while the line 57 are score or fold lines 57. The tabs 59 at the top are placed into the slits on the bottom to make a square. It should be note that it does not need to be square and can instead be a thin "shelf-like" structure as shown in FIGS. 8 and 9.

Figure 12:
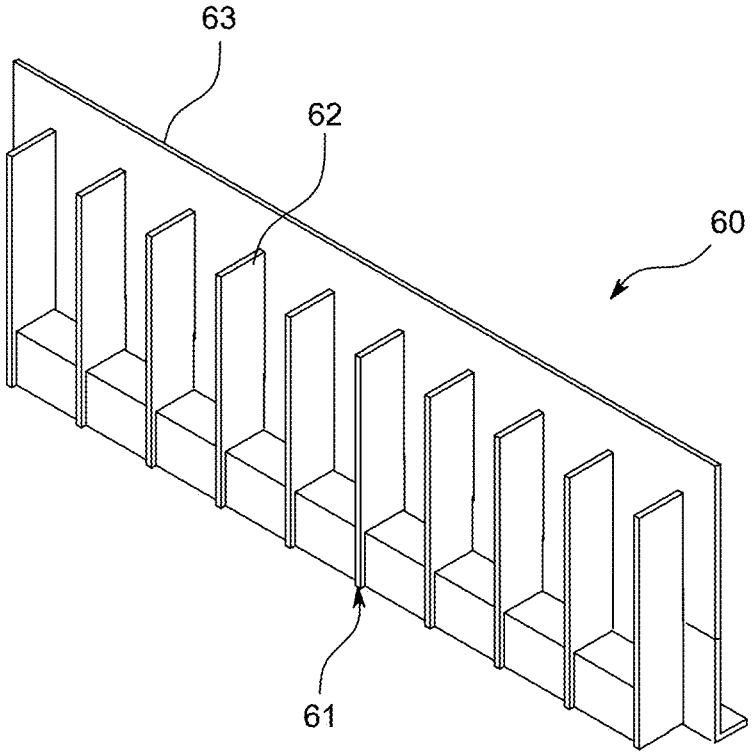
FIG. 12 shows a paper fillets 60 formed from the design 55 shown in FIG. 11.

FIG. 12 shows a paper fillets 60 formed from the design 55 shown in FIG. 11. The slits 61, slats 62 and rear photo 63 are shown. Paper fillets 60 can be made with different dimensions to make a thinner shelf-like structure. The space between the fold lines can be altered to create rectangular size or reduced height instead of the square size. In the design 55 as shown in FIG. 11, the size of the places 58 can be altered to make shorter or taller paper fillets. The height of the areas above the places 58 determine the size of the "shelf" that is created.

In one embodiment of the invention, different spacing for different viewing angles can be created. Viewing angle is based on the spacing between the slits. For example, one-inch slit and one-inch wide slat creates a 90-degree angle between them and creates a 45-degree viewing angle to the image on that slat. That angle can be made smaller by reducing the space between the slits. This allows the images to be seen straight on more. To allow users to view the images from greater angles with respect to the front of the frame, the viewing angle must be increased by positioning the slits further apart. The system subject of the present invention generates the appropriate sizing needed for the slats and the distance between the slits based on the viewing angle desired by a user. Generally, a user will first select the size of the slats that an image will be mounted to on both sides of the slat. Next, the user will input the size of the slat selected into the system. Then, the user will select either the viewing angle or spacing between slits desired. The system will then determine the spacing between the slits and then a 3D printer can print a frame having the slits at the distances as specified by the system. Based on slat depth and slat spacing, the software can calculate the viewing angle. Based on viewing angle and slat spacing, the software can calculate slat depth. Based on viewing angle and slat depth, the software can calculate slat spacing. Based on the number of slats and a frame opening width, the software can calculate slat spacing as well. The user can select whether the slit distances will be applied onto slits in a fillet assembly, slits carved into a frame, or slits in a paper fillet assembly.

It should be noted that the design 55 shown in FIG. 11 is one embodiment of cut and fold design, other variations, such as slits of different spacing, different size thickness of tabs, and other options are possible without limitation, to achieve the objective of the present invention. In one another embodiment of the invention, the tab in the design can be continuous and forms a single vertical wall in the fillets, such that the slat fits against or slides onto a groove in the bottom of the fillet.

In one another embodiment of the invention, there is only one of tabs rising from the frame or fillet, to create the place where artwork is attached. The tabs can even have holes in them where an insert can be made to further attach/secure the strip(s) to the tab. The strips themselves can have slits that slide onto the tabs.

Figure 13A:
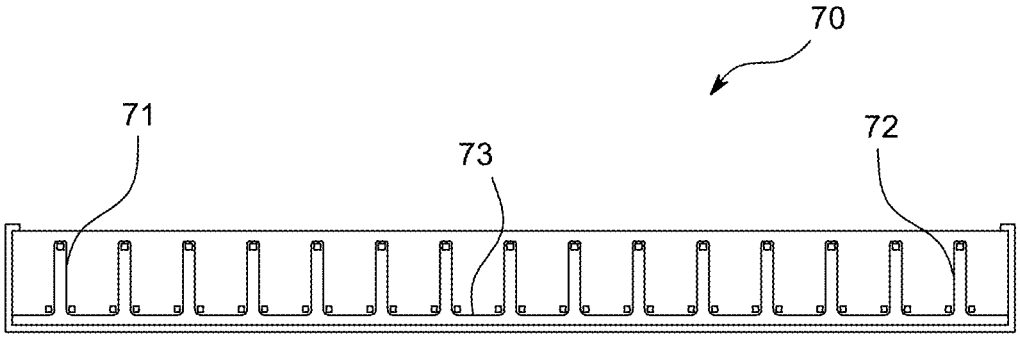
FIG. 13A and FIG. 13B each shows top and oblique view of tri-fold weave box 70.
Figure 13B:
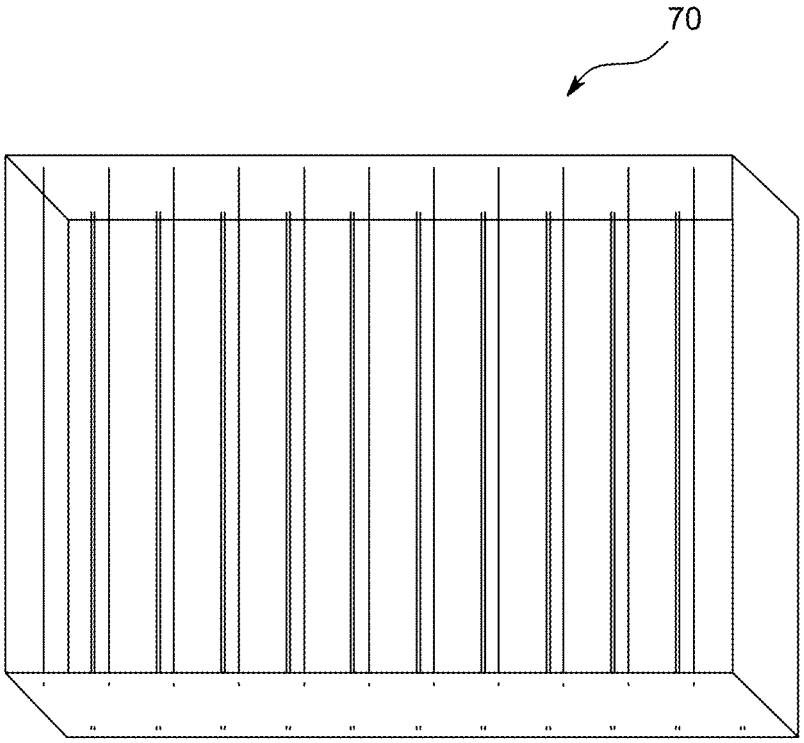

FIGS. 13A and 13B shows top and oblique view of tri-fold weave box 70. This box 70 holds paper, plastic or Mylar with the image printed on it. The image is "threaded" through the pins or threads to create the slats. FIG. 13A clearly shows, the position 71 where strips or sections of the right image are placed, the position 72 where strips or sections of the left image are placed and the position 73 where strips or sections of the center image are placed.

One embodiment of the invention has transparent vertical sleeves for images that are inserted into the frame so that the strips of artwork can be placed into the sleeves and the back-artwork placed behind the insert. The other material used for tri-fold can be, a framing system package in a mold or cut and folded from a single piece of plastic. Another embodiment of the invention uses an automatic electronic cutting machine by using the cutter's file format, to include cuts and/or scores. For example, the design 55 of FIG. 11 can be made from electronic cutting machine.

The tri-fold is made of sleeves and teeth. The teeth allow the sleeves for the slats to be created at a shorter length than the back. This allows the sleeves to stand up when folded, but still provides support and an overhang for the back to be placed into a frame. The tri-fold is then folded and taped to the cutting mat to keep it in position for the photo, because there is no frame to hold it in place. The continuous tri-fold can be inserted into the frame such that the strips of back image are in the sleeve, strips of left image are in left side of the slabs and strips of right image are in right side of the slabs.

Figure 14:
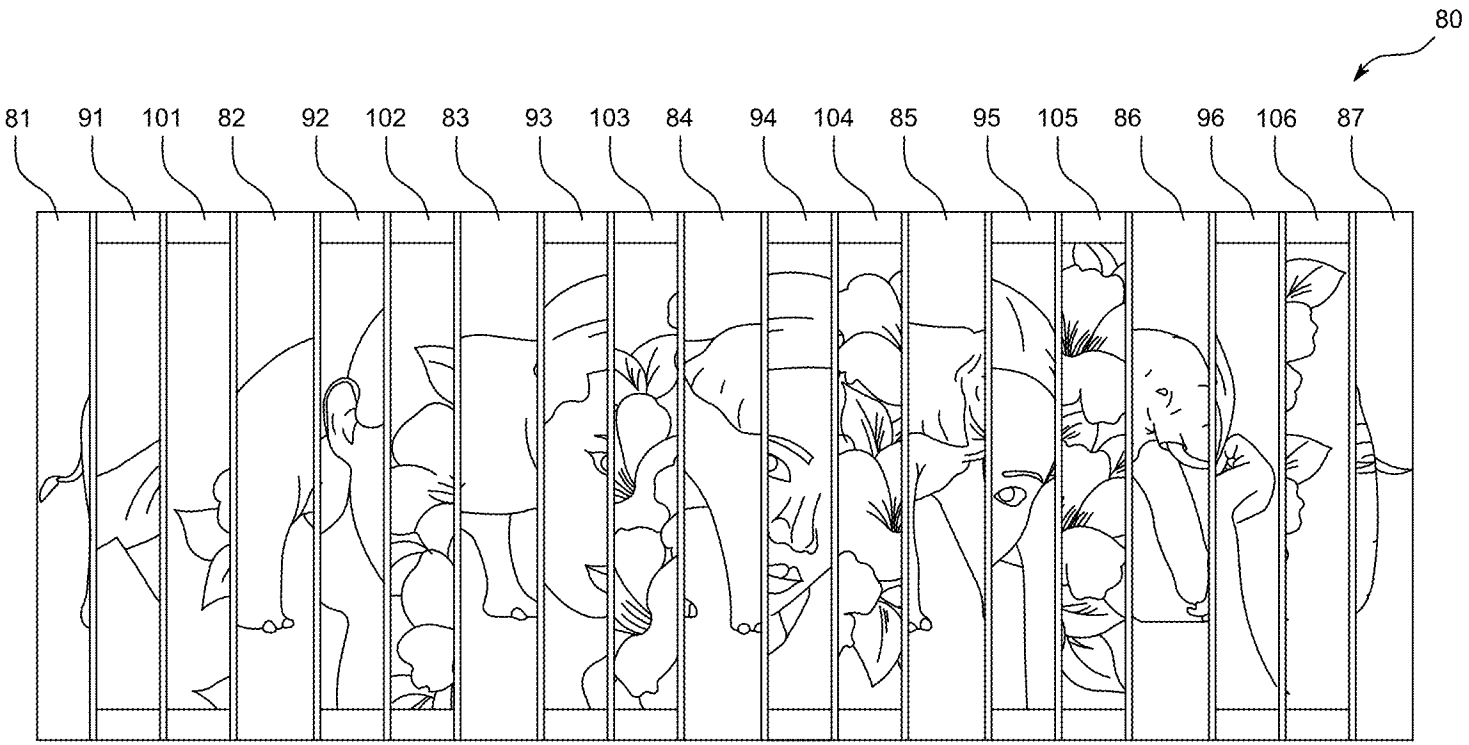
FIG. 14 shows a tri-fold 80 for images arranged in the trifold pattern.

FIG. 14 shows a tri-fold 80 for images arranged in the trifold pattern, containing all three images on one piece of paper or plastic. Trifold images printed as one flat and contiguous image. It should be noted that the inner slats are shorter than the back slats. In one embodiment of the invention, the left and right edge are half of a back-slab width so that the slats are centered over the open space in the frame. The portions 81, 82, 83, 84, 85, 86 and 87 corresponds to center image. The portions 91, 92, 93, 94, 95 and 96 correspond to left image and the portions 101, 102, 103, 104, 105 and 106 correspond to right image. Thus, a single piece of art 80 is produced such that it can be folded to make a tri-faced presentation. The final folded artwork 80 can be self-supporting, placed in slits, in sleeves of a transparent trifold, or it can be threaded between supports of pins or strings. The final product can be mounted on a sturdy backing, such as wood, plastic, metal.

Figure 15:
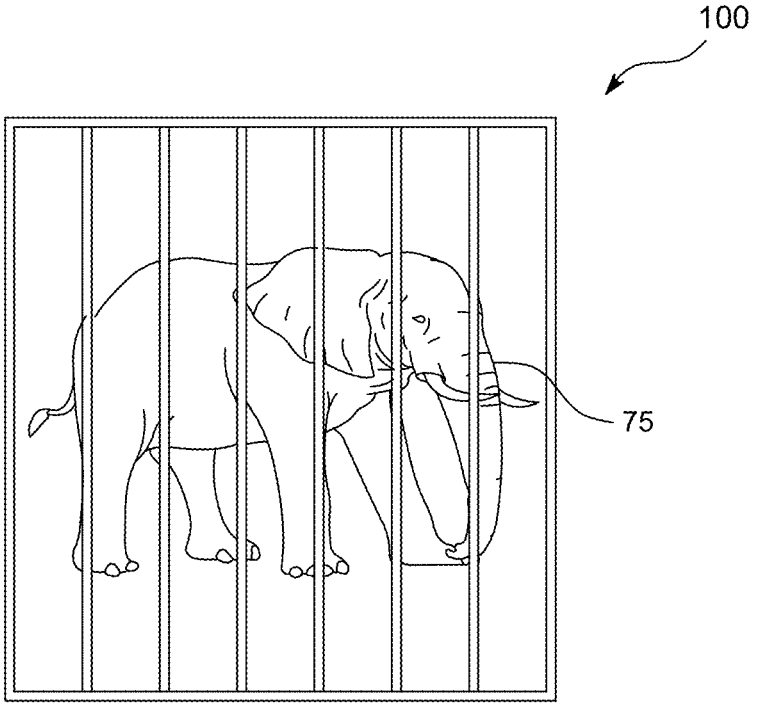
FIG. 15 shows a tri-face artwork display 100 viewed from center.
Figure 16:
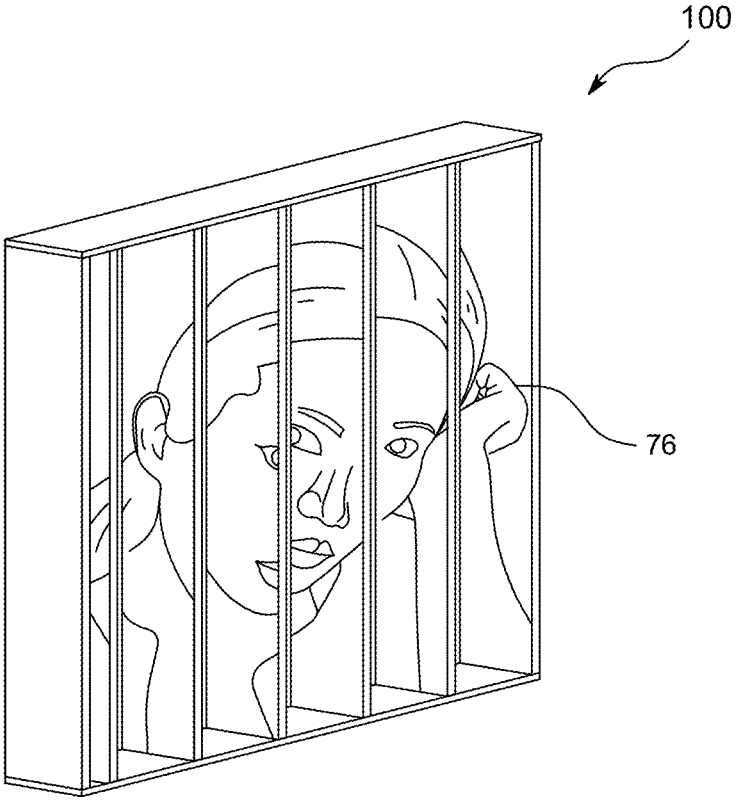
FIG. 16 shows a tri-face artwork display 100 viewed from left side.
Figure 17:
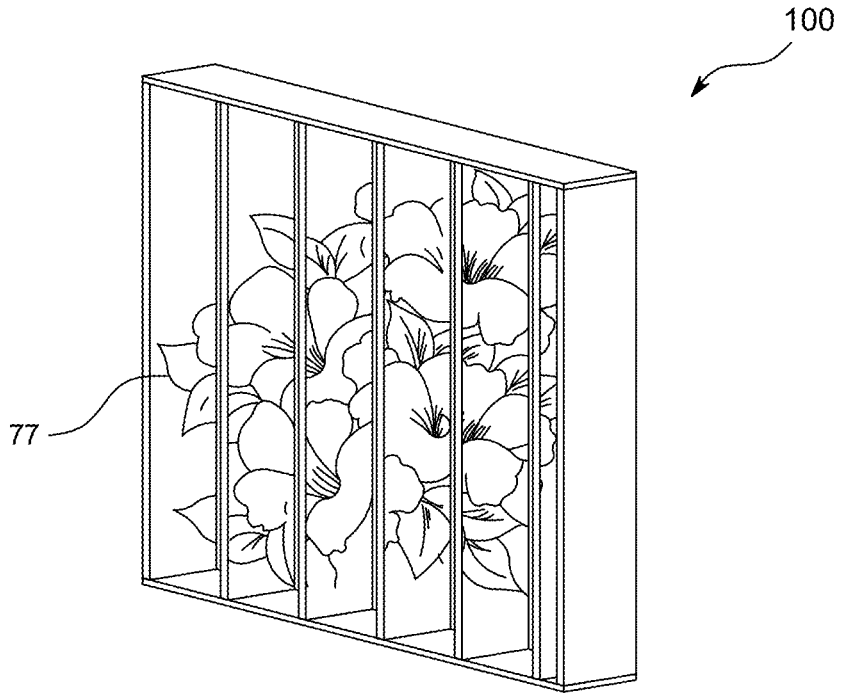
FIG. 17 shows a tri-face artwork display 100 viewed from right side.

FIG. 15 shows a tri-face artwork display 100 viewed from center. When viewed from center, the center or the back image 75 will be visible. FIG. 16 shows a tri-face artwork display 100 viewed from left side or at a left angle from the center. When viewed from left, the left image 76 will be visible. FIG. 17 shows a tri-face artwork display 100 viewed from right side or at a right angle from the center. When viewed from the right, the right image 77 will be visible.

Figure 18:
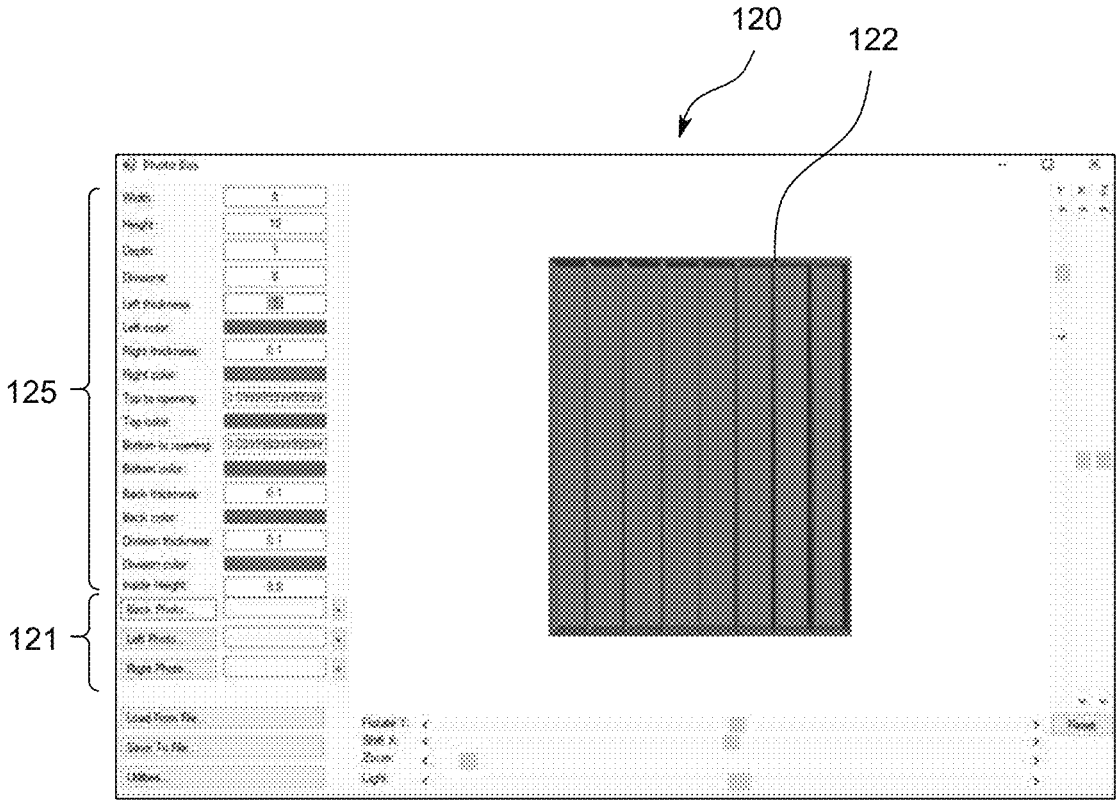
FIG. 18 shows a screen shot 120 of trifold simulator software used to select various parameters for generating a trifold.

The trifold image and the fold and marking for making the fillet assembly and frame can be made with a trifold simulator software. FIG. 18 shows a screenshot 120 that allows a user to select or enter the details 125 such as, without limitation frame size, number of slats, edge and fill colors. The software, based on the number of slats, slat spacing, and frame opening width can calculate the placement of the slats. In such a manner that the back image shows half a slat width of the image or from a user specified starting left point. The three images can be loaded, by using the buttons 121 as shown. In real time, once the features are selected or entered, the frame with user entered details will be displayed to the user. The user can in view how center image 130, left image 140 and right image 150 will look after printing and installing the artwork in a display, as shown in the screen shots 124, 131 and 132 of FIGS. 19-21. It should be noted that the software allows other options, without limitation, like scroll bars, allow zooming, rotating, tilting and all forms of three-dimensional manipulation of the image for seeing the results from a variety of angles and light sources.

Figure 19:
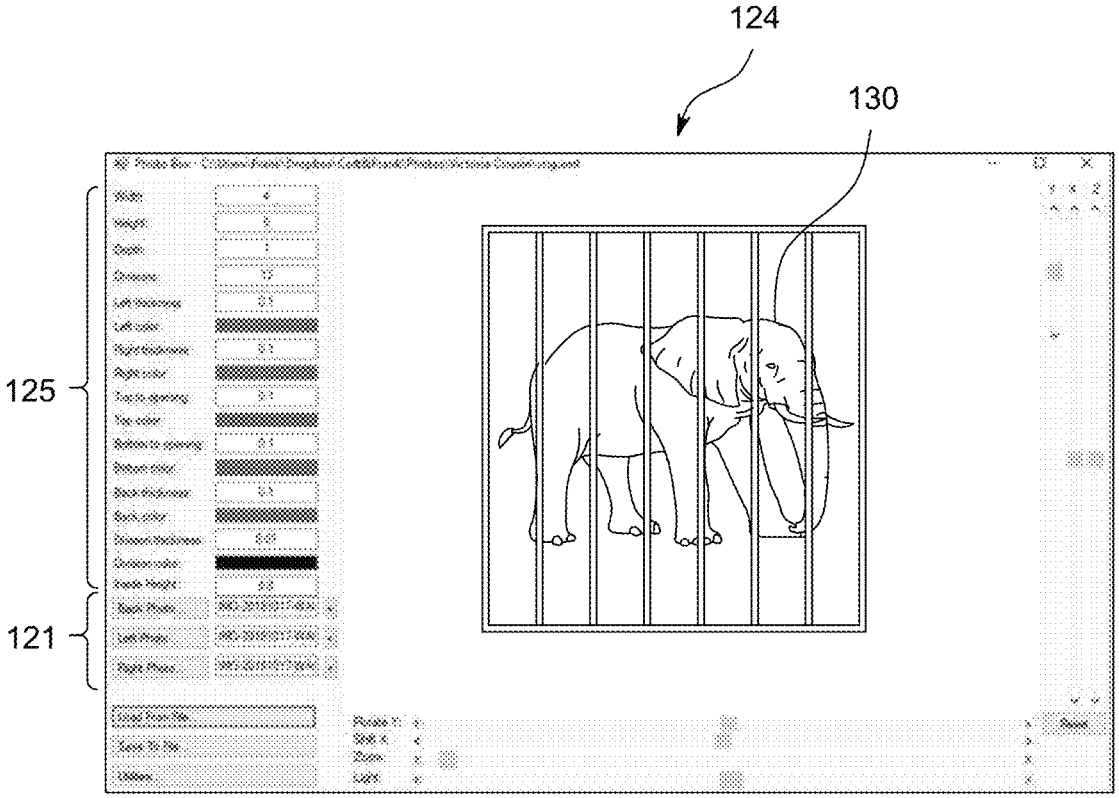
FIG. 19 shows a screen shot 124 of trifold simulator software showing center image.
Figure 20:
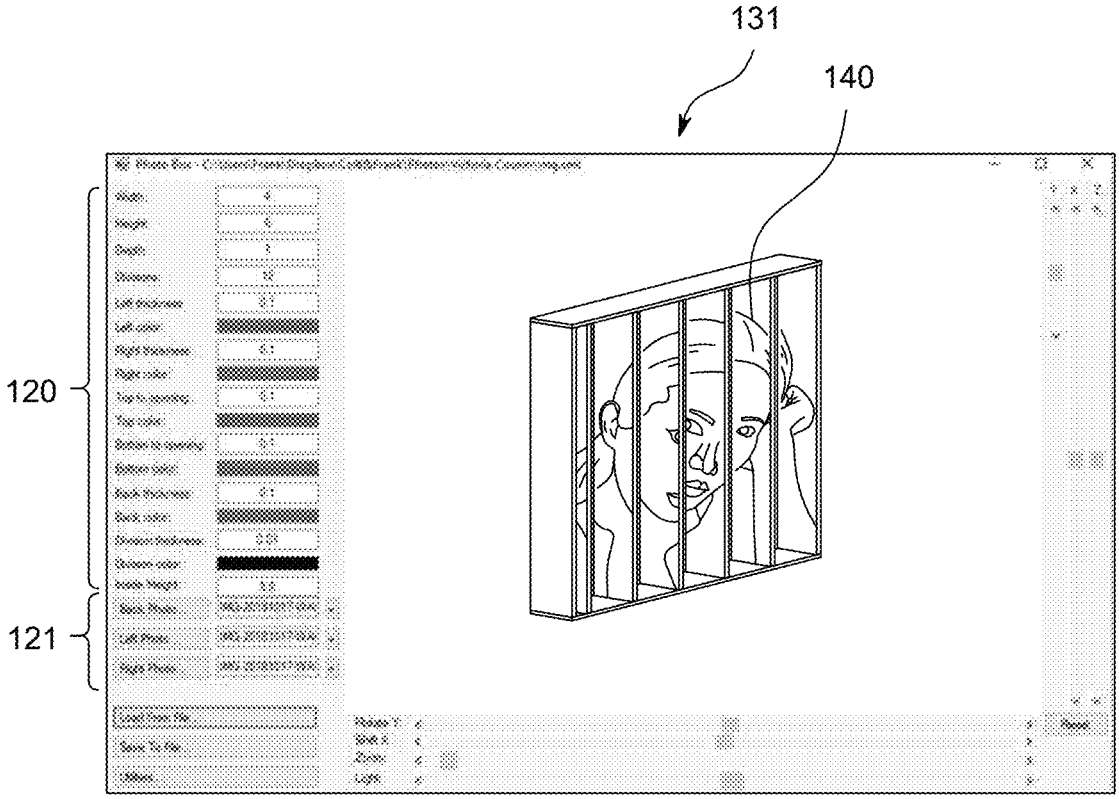
FIG. 20 shows a screen shot 131 of trifold simulator software showing left image.
Figure 21:
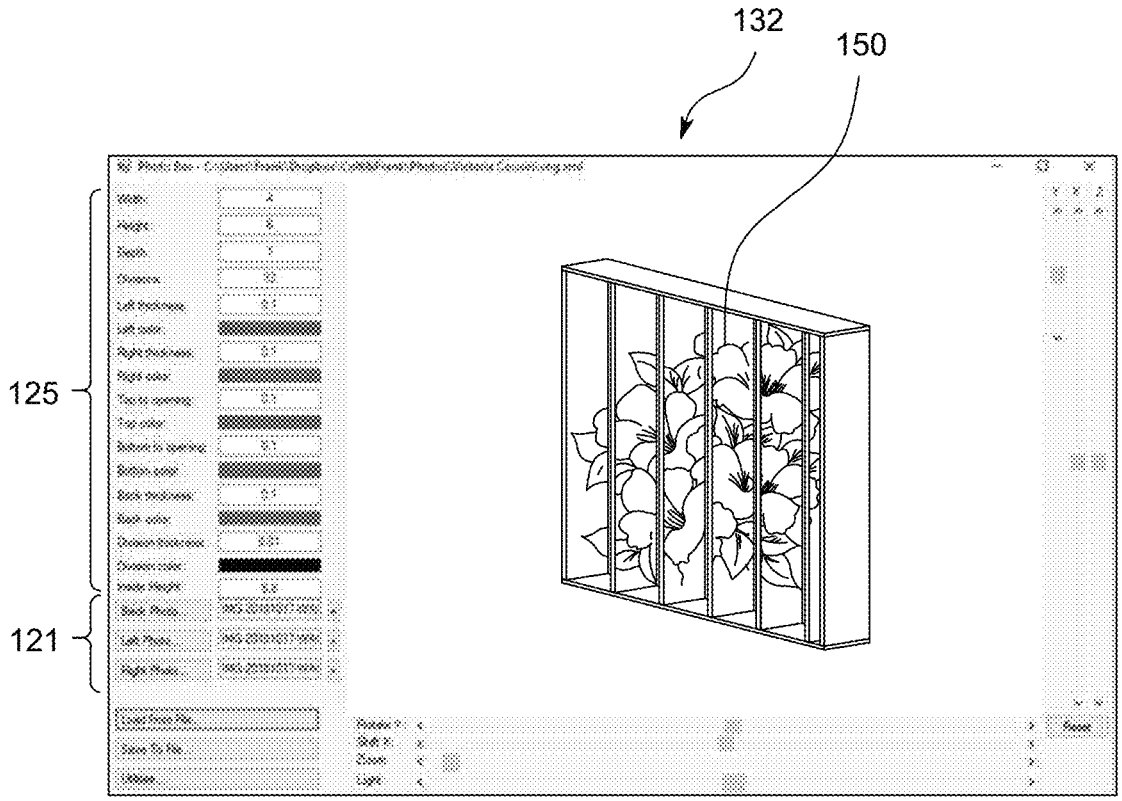
FIG. 21 shows a screen shot 132 of trifold simulator software showing right image.

A user can preview the tri-view artwork by creating a three dimensional model on the computer using three dimensional model generator, as shown in FIGS. 19-21. The images can be rotated, zoomed, and so on. A user can specify, the number of slats to match a number of slits, the depth of the slats, the size of the frame opening, the size of the matting, the thickness of the slats and the thickness of the frame and the back. From those user inputs, the software can proceed to make certain calculations. Based on fillets used and matting size, frame opening viewable height can be calculated. Based on fillet type and frame viewable opening size, slat height can be calculated. Based on slat width and border options, the image strip size can be calculated. Outer strips of the image can go on the outer wall of the frame itself (for shadow boxes) or can be completely contained within the opening. An image cropping tool allows cropped images to fit the slats or the back image correctly. Aspect ratio of artwork can be preserved or the image can be stretched to fit the available space. Measurements and offsets can be entered in a variety of units of measure, and even the measurement can be adjusted by a different unit of measure. For example, you can specify ten and half inches minus two millimeters. The fractions can be entered in a variety of ways for ease of use and to match real-world rulers. As an example, you can specify a width as ten and half inches, minus two millimeters. This is a new concept in entry of sizes, where a base amount, a fraction and a positive or negative nudge factor can be specified. Any of the units can be specified with fractions, units of measure, and the nudge factor. Slice the images into individual images for each slat that can be manually placed on either side of a slat. The number of slats and their size and the final print resolution and paper size can be specified. A file for an automated cutter can be generated to cut pre-existing artwork.

In one embodiment of the invention, the simulator software has a cropping tool to fit the slats or to fit the back-image size, with an interactive sizing of the slats and positioning. This allows users to visually see where the slats will split the image and thereby achieve the best results of where cuts happen. This allows the user not to worry whether the cut will happen at an eye or other portions that the user wants to retain or show. After cropping, the results are loaded back into the simulator.

Figure 22:
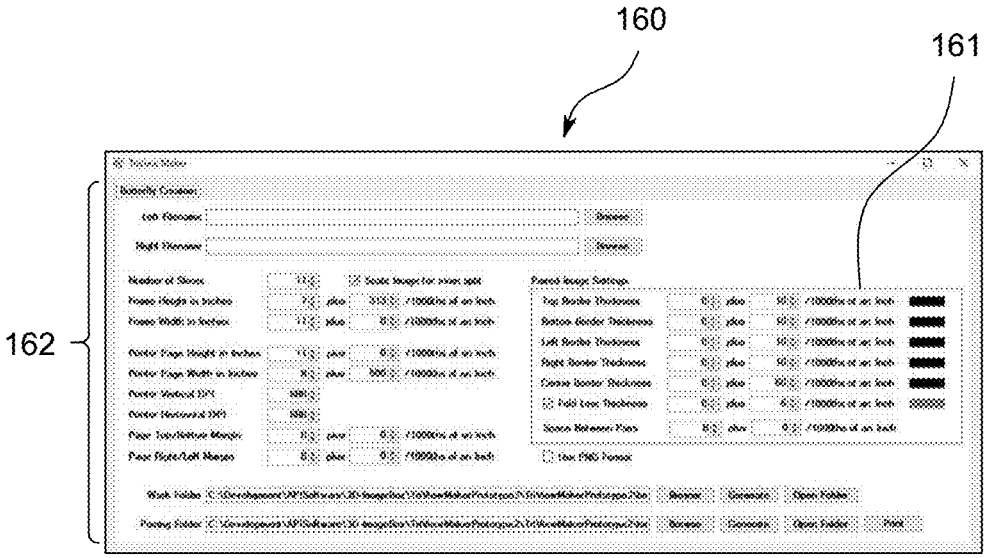
FIG. 22 shows a screen shot 160 showing the butterfly maker feature of the simulator software.

FIG. 22 shows a screen shot 160 showing the butterfly maker feature of the simulator software. This feature slices the left and right images, then combines them with the specified options. The options 162 and 161 can be selected or entered by the user to obtain specified slices of the right and left image that will be used in the artwork display. It slices the left and right image and reassembles the strips of images to create artwork to be used in the slats of tri-faced artwork. The number of slats and their size can be specified. The final print resolution and paper size can be specified. Image size, frame size, and paper size and resolution can be specified. Image output formats can be specified as butterflies, which are a combination of one left and one right strip of the image such that the two separate images comprise the left and right of a slat display when folded. Slats can be positioned on the page to minimize the amount of wasted paper, with or without borders or spacing between the slats. Optionally with a middle strip of color that faces outward, to give spacing for the fold. Optionally, the fold area can be replaced with a middle strip of the back image, instead of a solid color, so that the head-on view shows the entire back image. Optionally with a fold-line in-between the two images. Also, optionally, a border can be produced of a definable thickness and color around left, right, top and/or bottom of the butterfly.

Figure 23:
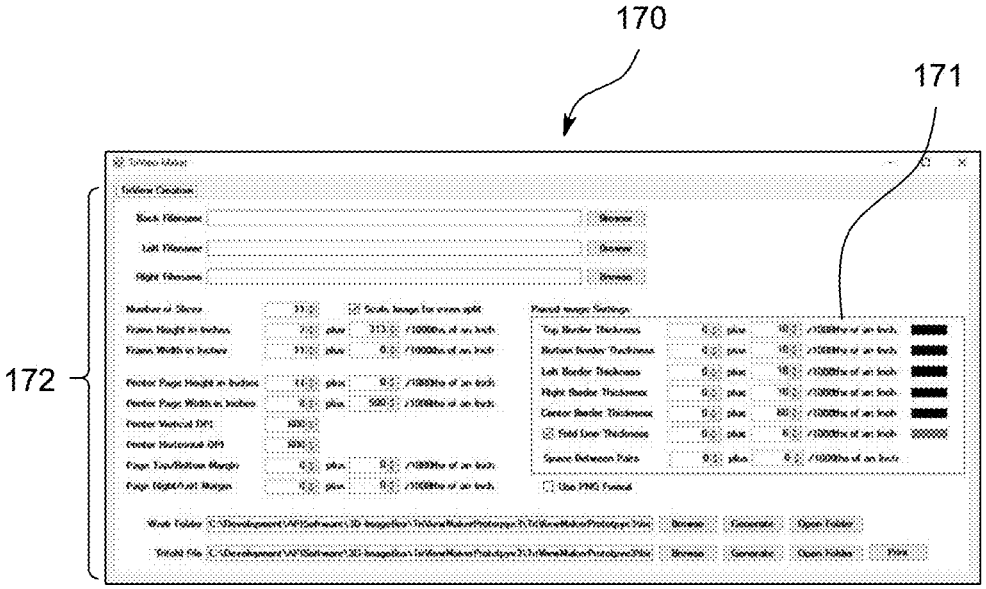
FIG. 23 shows a screen shot 170 showing the trifold maker generator feature.

FIG. 23 shows a screenshot 170 showing the trifold maker generator feature. This feature slices three images, then combines them with the specified options. The options 172 and 171 can be selected or entered by the user to obtain the specified slices of center, right and left images that will be used in the artwork display. Slices of the three photos back, left and right images can be reassembled into a single tri-faced image and can be folded to create the artwork. Options of butterfly maker feature explained above are applicable in the tri-fold marker generator also.

The overall size of the final printed artwork is calculated based on all of the above options or the image can be word-wrapped onto specific paper sizes. The resulting output can be produced as one continuous image or tiled onto smaller paper and re-assembled into one long image. Optionally, the slats can be a different size than the background image so that the slats fit inside the frame. The left and right edges, representing the left and right portions of the original back image for the trifold are half the width of the other strips so that the slats, when folded to stand up, are centered in the frame. In other words, the spacing is calculated to center the slats within the opening. It should be noted that the various options selected in each screen shot refers a plurality of parameters that are selected or entered for performing the particular screen shot task.

Figure 24:
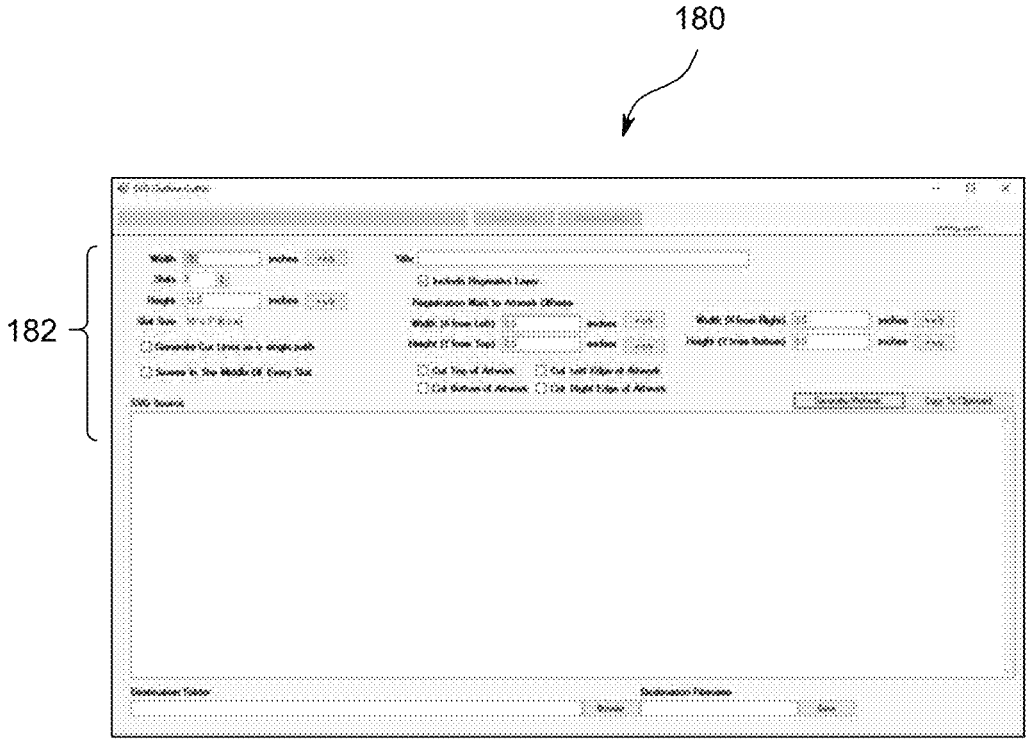
FIG. 24 shows a screen shot 180 showing a SVG (vector file format) cutter or scoring outline generator.
Figure 25:
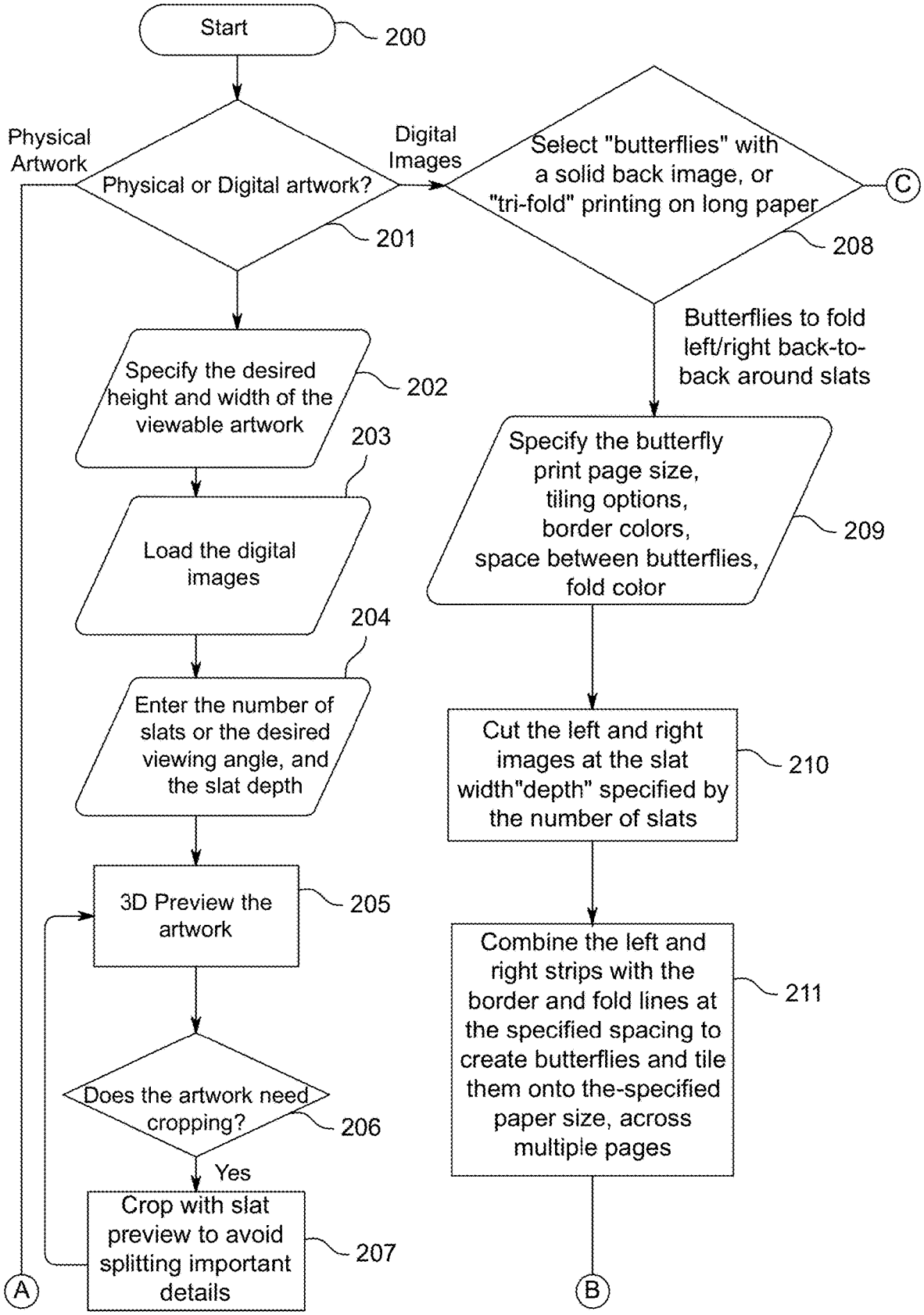
FIGS. 25, 26, 27, and 28 show a complete flow chart of creating artwork using trifold simulator software, butterfly marker, trifold maker generator SVG (vector file format) cutter or scoring outline generator of FIGS. 18, 22, 23 and 24.
Figure 26:
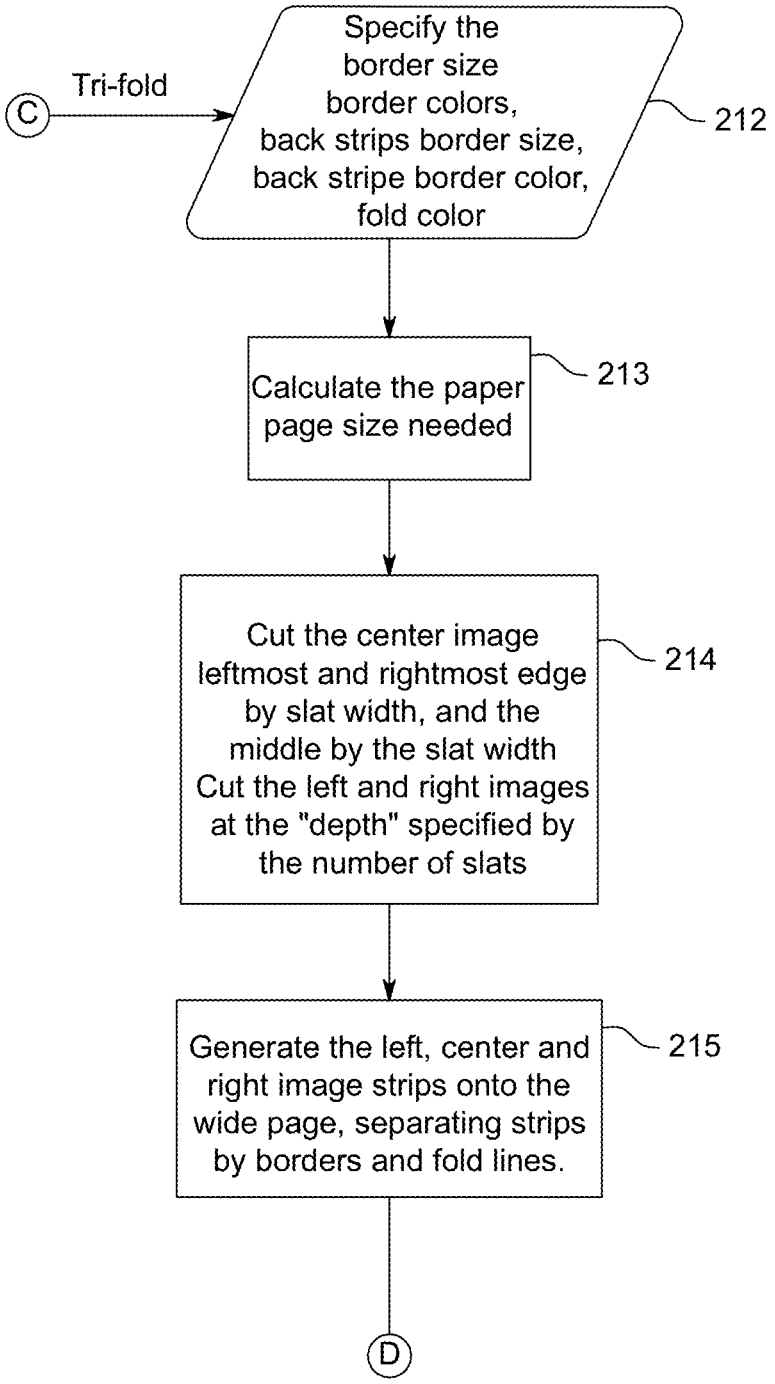
Figure 27:
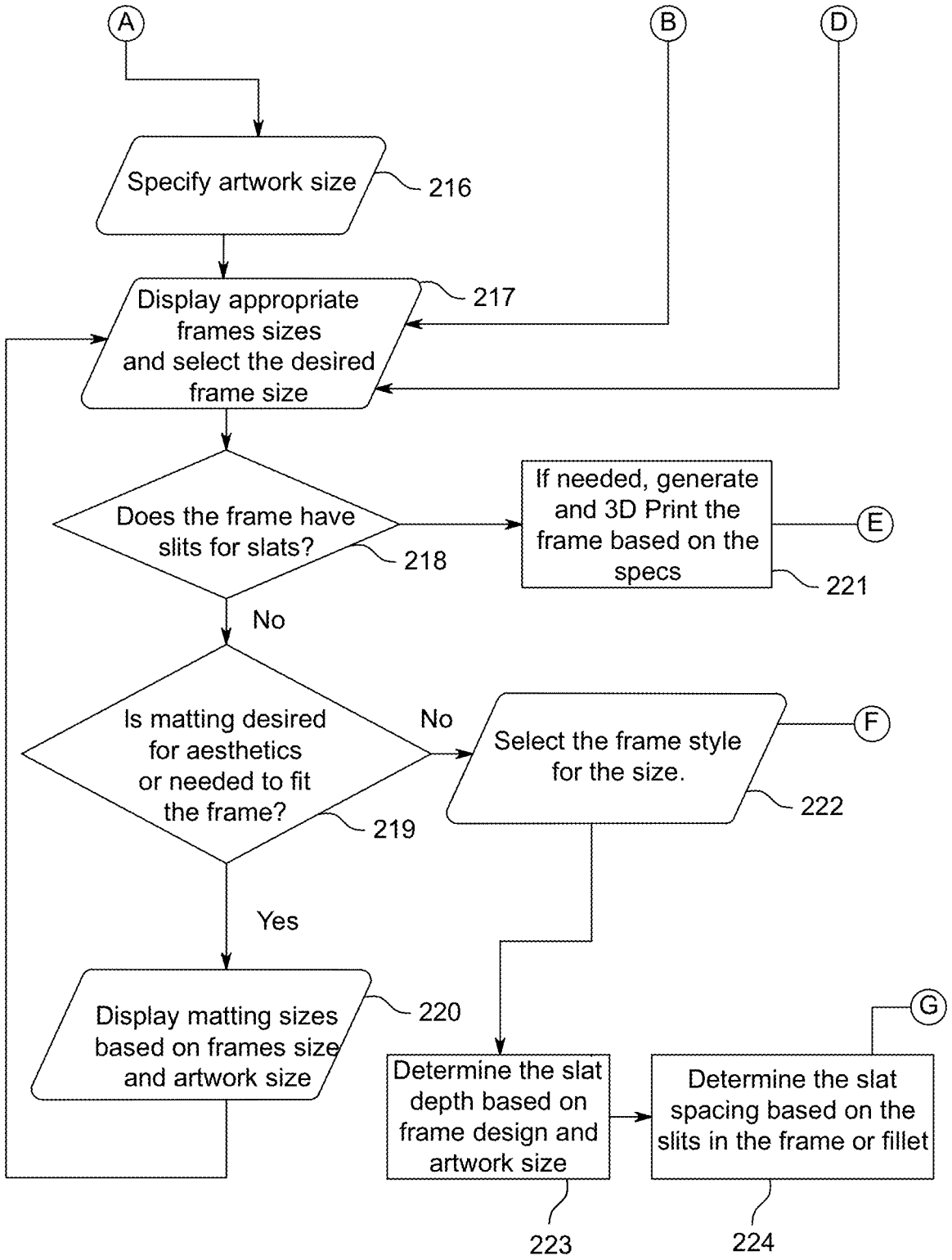
Figure 28:
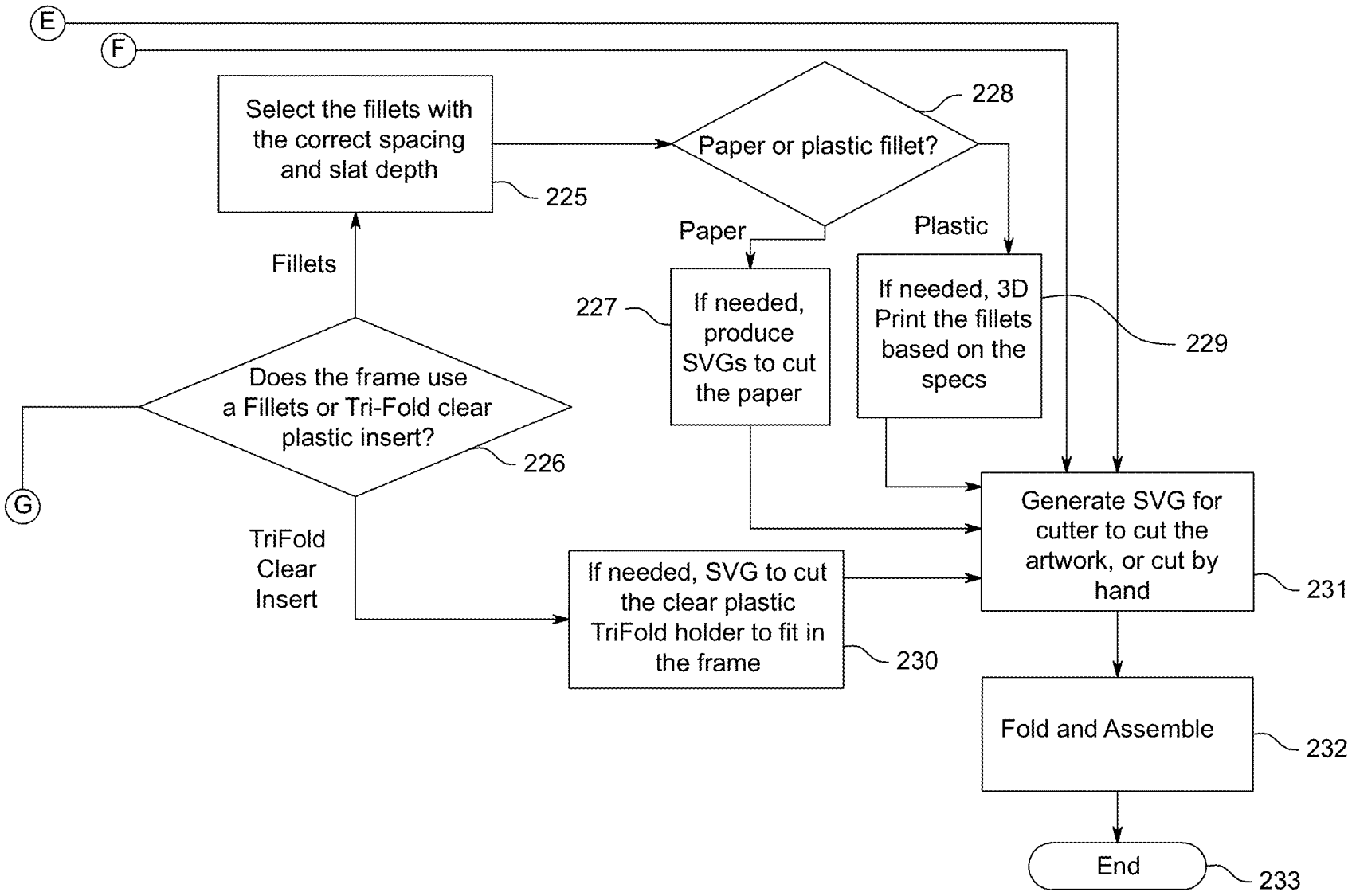

FIG. 24 shows a screenshot 180 showing a SVG (vector file format) cutter or scoring outline generator feature. An SVG (vector file format) can be produced to cut and/or score the artwork or the sleeves on popular electronic cutters and their software. A user can elect various options 182 in the screen. The various options 182 can include cuts that create the cutouts needed to assemble the artwork and fit it into a frame and scoring that marks the artwork for folding. The user can also specify different pressure settings to cut or score different materials. The generator can create registration marks, either at the edge of the paper or offset to the artwork, or in-between. The outline of the artwork can be cut into strips only, cut as butterflies, or cut as a trifold. Also allows to include registration marks for the automatic cutter. Further, the options for how to generate the SVGs are included, for example, a single path or individual cut vectors. Options such as whether to cut the outline, or just the interior can be specified. This will be great for pre-existing artwork cutting, such as existing photos or existing posters.

FIGS. 25 through 28 show a complete flow chart of creating artwork using the physical method and the software method. As at step 200, the complete flow chat process starts. The user needs to decide how the artwork is created, either by the physical process or by the software-based method, as at step 201. As at step 202, using software, desired height and width of the viewable artwork are specified. Then three images, center, left and right images are loaded in the software, by selecting appropriate options, as at step 203. The user can enter number of slats or the desired viewing angle, and the slat depth details, as at step 204. Based on slat depth and slat spacing, the software can calculate the viewing angle. Based on viewing angle and slat spacing, the software can calculate slat depth. Based on viewing angle and slat depth, the software can calculate slat spacing. The user can then preview the three-dimensional model, as at step 205. As at steps 206 and 207, in case the user wants to crop the images, he/she can perform cropping of the images and then preview again. This avoids splitting or removing important details.

In the case where digital images are used, the user can select butterflies with a solid back image or tri-fold printing on long paper, as at step 208. When a butterfly option is chosen, the user can then specify the butterfly print page size, tiling options, border colors, space between butterflies and fold color, as at step 209. From these user inputs the software can calculate the placement of butterflies to fit on a page either horizontally or vertically. As at step, 210, the left and right images are cut at the slat width depth specified by the number of slats. The left and right strips are combined with the border and fold lines at the specified spacing to create butterflies and tile them onto the specified paper size, across multiple pages, as at step 211.

In the case where the trifold option is selected, as at step 212, the user specifies the border size border colors, back strips border size, back stripe border color and fold color. Then, the software calculates the paper size needed for the trifold, as at the step 213. As at step 214, the center image's leftmost and rightmost edge are cut by slat width, and the middle is cut by the slat width. Also, the left and right images are cut at the depth specified by the number of slats. Then as at step 215, the left, center and right image strips are generated onto the wide page, separating strips by borders and fold lines.

In the case of physical artwork, the user can specify the art size, as at step 216. The appropriate frame sizes can be displayed to the user and the user can select the desired frame size, as in step 217. At step 218 and 219, in case the frames do not have slits for slats, the user can check whether matting is desired for aesthetics or needed to fit the frame. If required, matting sizes are displayed to the user based on frame size and artwork size. A user can use the details to prepare his/her own trifold artwork display.

In the case that frames are required as in step 219, the software generates and performs three dimensional printing of the frame based on the specifications. In step 219, if no matting is desired for aesthetics or needed to fit the frame, then as at step 222, the user can select the frame style.

After selecting the frame style, the software determines the slat depth based on frame design and artwork size, as in step 223. Then as in step 234, the slat spacing based on the slits in the frame or fillet are determined. As in steps 226 and 225, if the frame uses fillets, the fillets with the correct spacing and slat depth are selected. Users need to specify whether paper or plastic fillets are used, as in step 228. If plastic fillets are needed, as in step 229, three dimensionally fillets based on the specifications are printed. As in steps 226 and 230, if the trifold clear plastic insert is used, if needed, SVG cuts the clear plastic trifold holder to fit in the frame. Then the user can generate SVG for cutter to cut the artwork, or cut by hand, as in step 231. The user can then fold and assemble to create a trifold artwork display, as in step 232. The process ends at step 233.

The present invention further includes a framing system 300 also called a clear shadow box which basically includes a box assembly 320 and a flap assembly 340.

Figure 29:
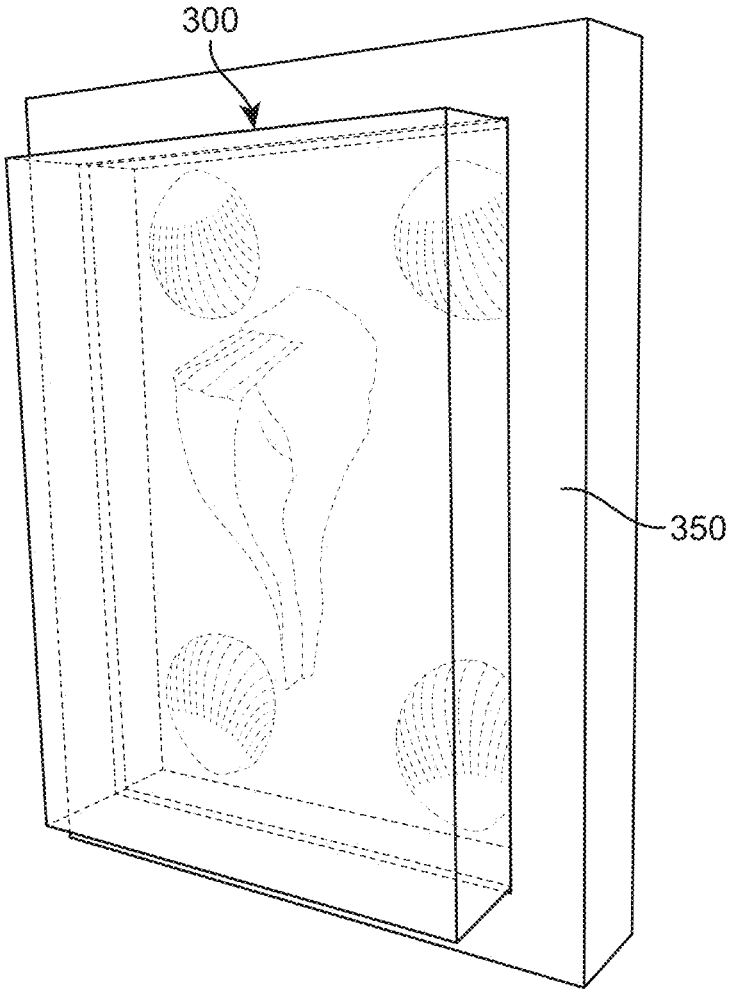
FIG. 29 represents an isometric operational view of a framing system 300 being inserted within a frame 350 in accordance to an embodiment of the present invention.
Figure 30:
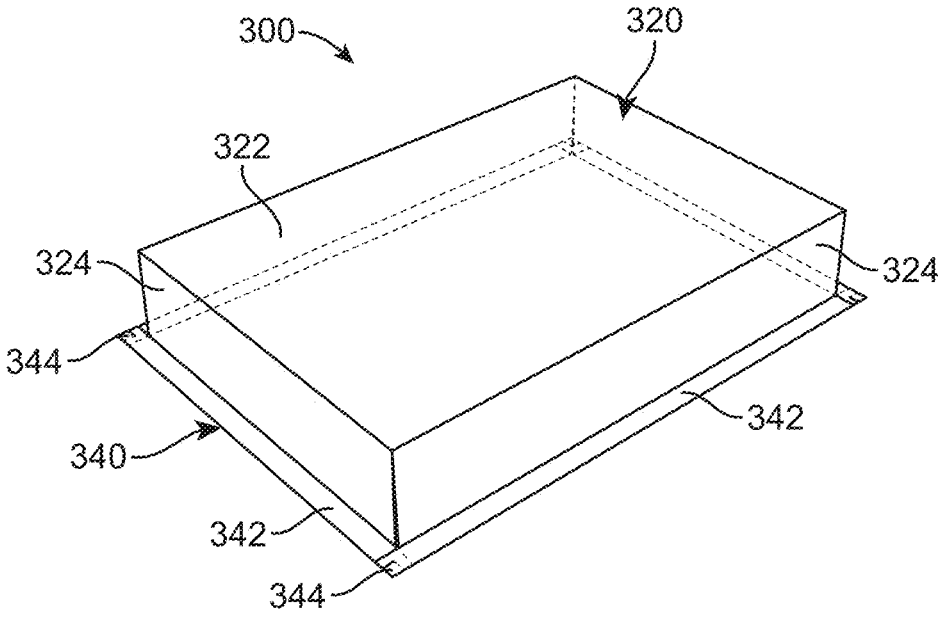
FIG. 30 illustrates an isometric view of a framing system 300 depicting a box assembly 320 and a flap assembly 340 in accordance to an embodiment of the present invention.
Figure 31:
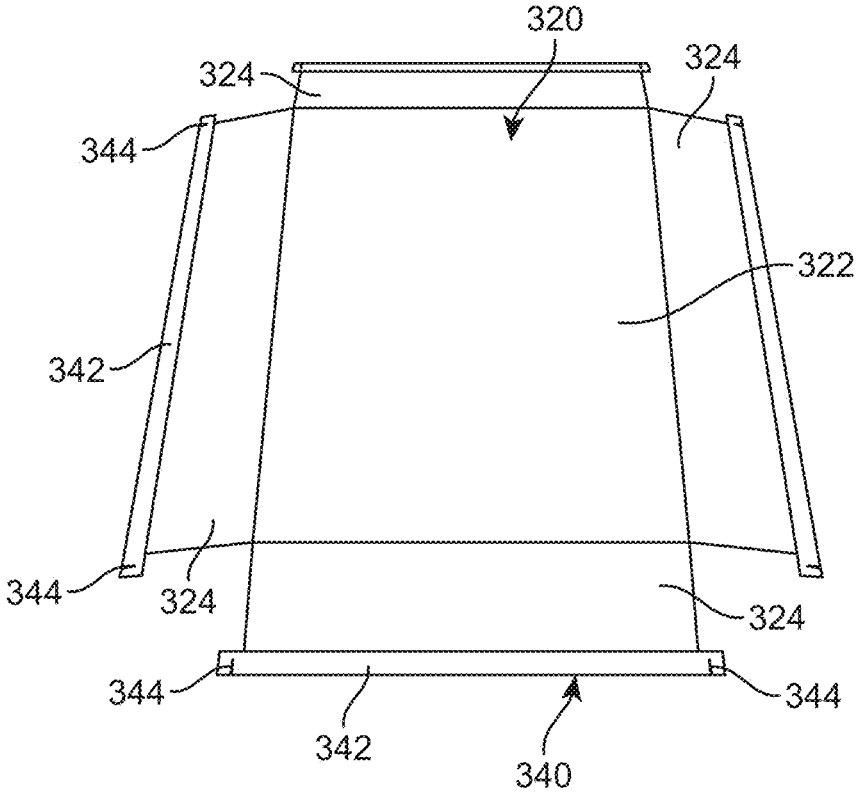
FIG. 31 shows a perspective view of framing system 300 in a flattened configuration in accordance to an embodiment of the present invention.

Box assembly 320 includes a front face 322 which may be accurately depicted in FIGS. 29, 30, and 31 of the provided drawings. In one embodiment, box assembly 320 is made of a clear plastic material. Other embodiments may feature a box assembly 320 made of other traditional clear materials. In one implementation, front face 322 is provided as having a rectangular shape which matches the size of a rectangular inner frame that is provided for frame 350. Front face 322 includes an outer periphery with four perimeter sides. It should be understood, the length of each perimeter sides may vary depending on the frame 350 that receives the framing system 300. In one embodiment, front face 322 is dimensionally structured to fit a 5×7 frame. In another embodiment, front face 322 is dimensionally structured to fit an 8×10 frame. In yet another embodiment, front face 322 is dimensionally structured to fit an 11×14 frame. It should be understood that front face 322 may be dimensionally structured to fit any variation of frame that is used for frame 350. Box assembly 320 further includes sidewalls 324 which each include a proximal edge and a distal edge. In the present embodiment, the proximal edge of each sidewall is in abutting connection with front face 322. Additionally, a distal edge of each sidewall is in abutting connection with flap assembly 340. A clear depiction of this configuration may be observed in FIGS. 30 and 31 of the provided drawings. In one embodiment, sidewalls 324 are provided as integrally connected to front face 322 and a crease line is formed which allows for the framing system 300 to be positioned in a box configuration and a flat configuration.

Figure 35:
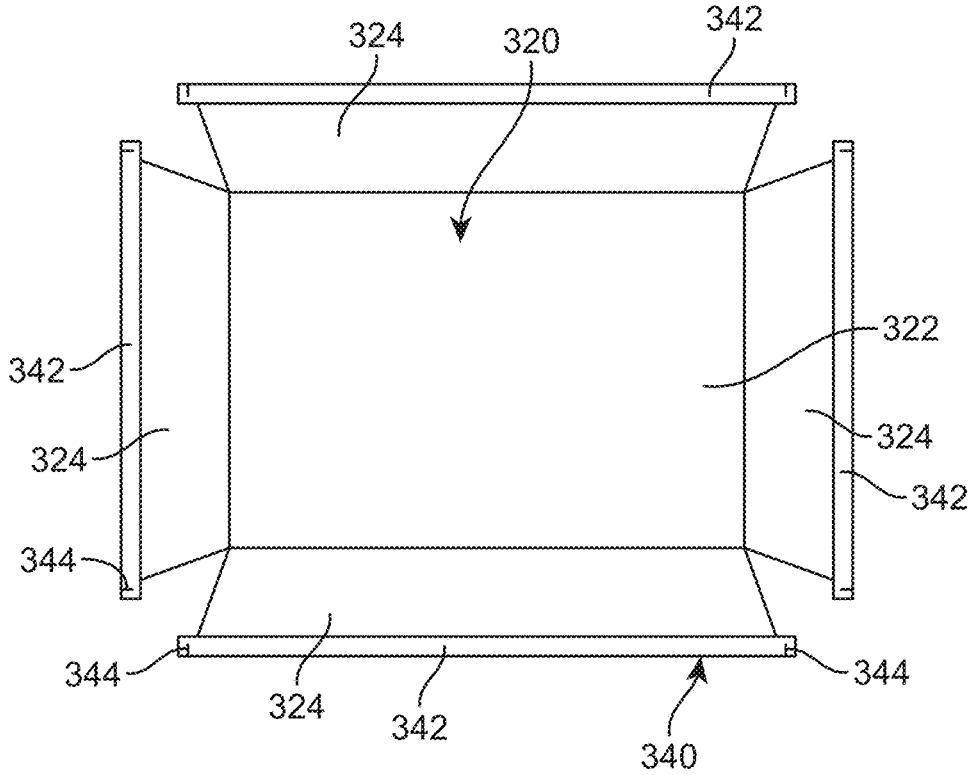
FIG. 35 represents a flattened front view of framing system 300 depicting yet another embodiment featuring sidewalls 324 having a trapezoidal configuration in accordance to an embodiment of the present invention.

A clear depiction of clear the box configuration may be observed in FIG. 30 of the provided drawings. In can be observed that sidewalls 324 stand upright and support the front face 322. In one embodiment, when formed, sidewalls 324 each form up to a 90-degree angle with respect to the front face 322. Since both sidewalls 324 and front face 322 are each made of a clear material, any item that is placed within the box configuration may be observed from any angle when viewing. FIG. 29 shows the box assembly 320 mounted to the frame 350. It can be observed that the sidewalls 324 extend upwardly from the bottom end of the frame and extends above the height of the frame. This structural configuration differs from traditional shadow boxes where the front face of the shadow box is flush with the frame. This traditional configuration limits the view of the contents that are displayed in the frame. The configuration of the present invention provides additional depth to any object or picture displayed within the frame 350. In one embodiment of the present invention, as observed in FIG. 35, sidewalls 324 may be provided as having a trapezoidal shape.

A clear depiction of the flat configuration may be observed in FIG. 31 of the provided drawings. In this configuration, the framing system 300 may be flattened and each of the sidewalls 324 are now not in abutting contact with each other. The present invention may effortlessly switch between the flattened and box configuration. This provides an effortless storage and set up configuration for the framing system 300.

Flap assembly 340 includes a flap 342 which is provided for each of the sidewalls 324 of the box assembly 320. A clear depiction of the flap assembly 340 may be observed in FIGS. 30-34 of the provided drawings. In one embodiment each of flap 342 is provided as a rectangular structure which is abutting with the distal edge of each of sidewall 324. Additionally, flaps 342 may be made of the same clear material as box assembly 320. It can also be observed that each of flaps 342 include a width that is greater than a width that is provided for the distal edge of the sidewall 324. This configuration serves a purpose such that a uniform outer frame edge is formed when the framing system is formed into a box configuration as observed in FIG. 30 of the provided drawings. This will be crucial when mounting the framing system into the frame 350. In one embodiment, when formed into the box configuration, each of the flaps 342 is folded such that at least a 90-degree angle is formed with respect to the sidewalls 324.

Figure 32:
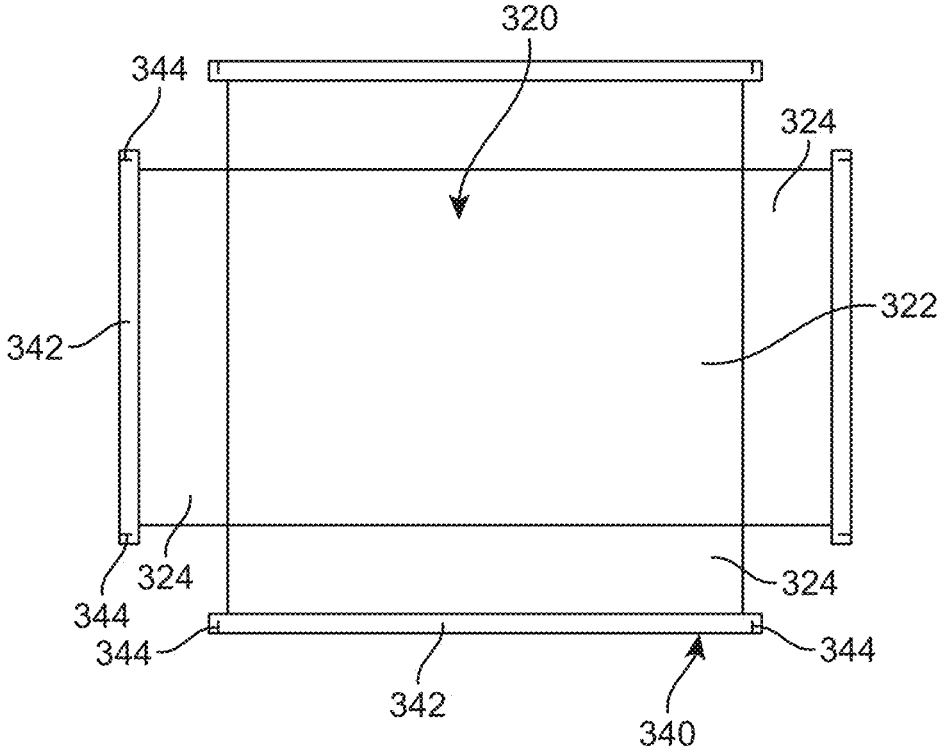
FIG. 32 is a representation of a flattened front view of framing system 300 depicting an embodiment featuring slits 344 in accordance to an embodiment for the present invention.

FIG. 32 depicts on embodiment of the framing system 300 wherein the flap assembly 340 includes slits 344 provided in sets of two for each flap 342. In this embodiment, the slits 344 are provided near the end portions of the flap 342. It is observed in FIG. 30 that, when the box configuration, slits 344 of a flap 342 are communicably engaged with the slits 344 and an adjacent flap 342. This structure effectively creates a locking mechanism for the flap assembly 340 thereby locking the framing system 300 into the box configuration. Once the framing system 300 is in this configuration, the uniform outer frame edge is then inserted into the rabbet of frame 350 in order to effectively mount the framing system to the frame 350. Other embodiments of the present invention may include other forms of latching mechanisms such as but not limited to adhesives, hook and loop fasteners, and the like.

Figure 33:
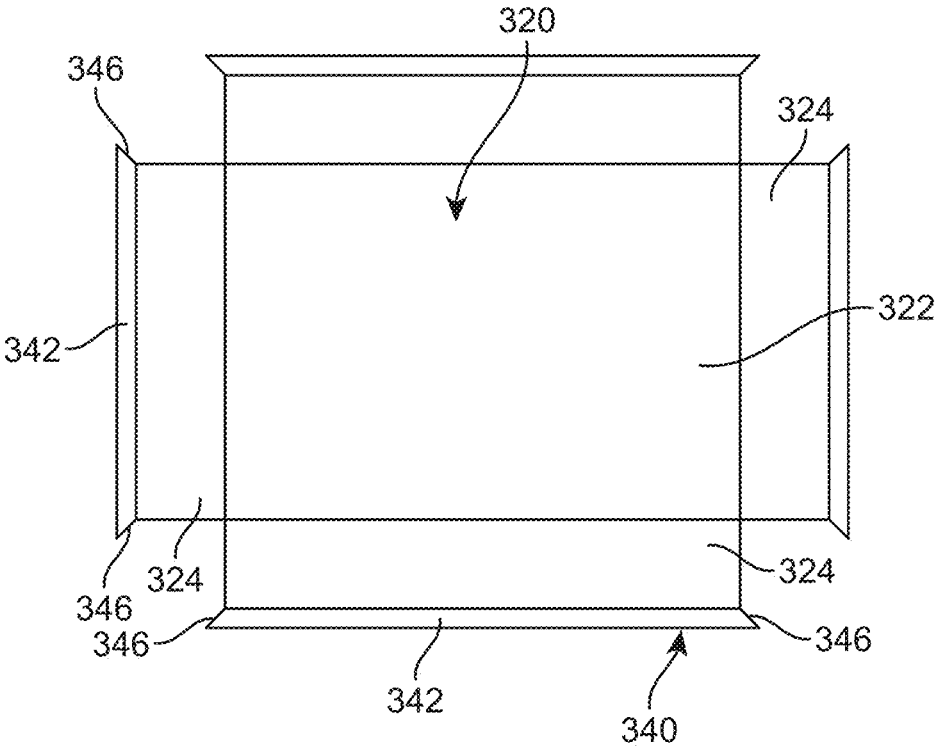
FIG. 33 illustrates a flattened front view of framing system 300 depicting another embodiment featuring slanted corners 346 in accordance to an embodiment of the present invention.

FIG. 33 depicts another embodiment of the framing system 300 wherein the flap assembly 340 includes slanted corners 346 provided in sets of two for each flap 342. In this embodiment, when formed into the box configuration, each of the slanted corners 346 of abuttingly meet with each of flaps 342 at a 45-degree angle. Each of the flaps 342 are then inserted into the rabbet of frame 350 which support the framing system in the box configuration.

Figure 34:
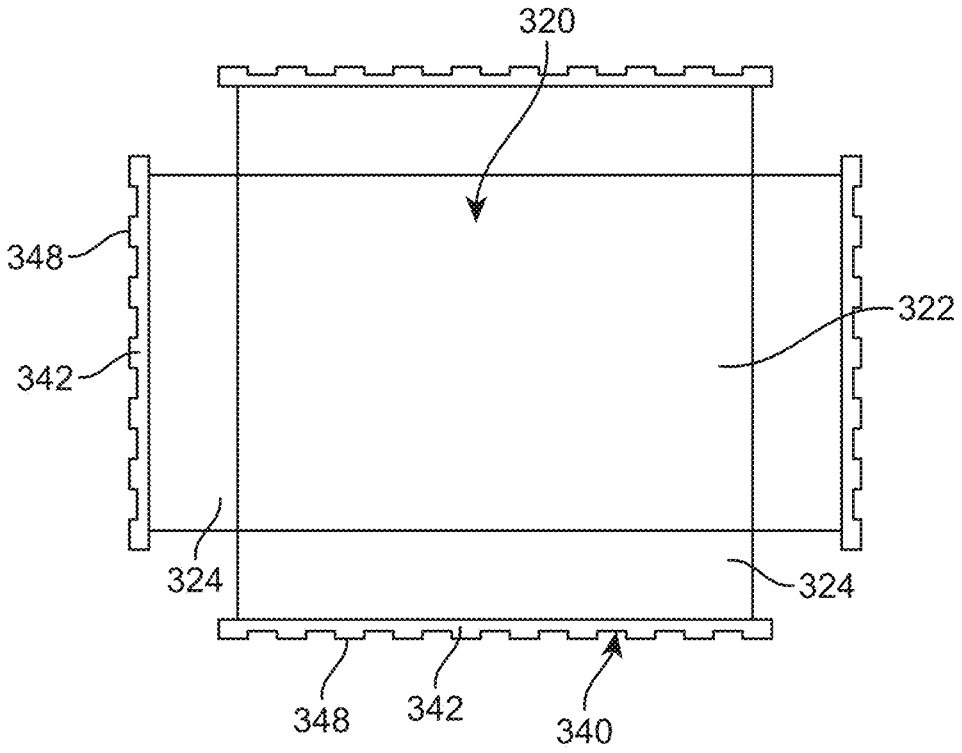
FIG. 34 shows a flattened front view of framing system 300 depicting yet another embodiment featuring a crenellation pattern 348 in accordance to an embodiment of the present invention.

FIG. 34 depicts yet another embodiment of the framing system 300 wherein the flap assembly 340 includes a crenellation pattern 348. In this present embodiment, each of the flaps 342 are abutting with the distal edge of the sidewalls 324. Furthermore, as depicted, each of the flaps 342 have a width which is greater than the width of their respective sidewalls 324. Each of flaps 342 are then inserted within the rabbet of frame 350 to be mounted thereon. However, it is known that rabbets often have varying depths. To account for this, crenellation pattern 348 is provided on the flaps. The purpose of the crenellation pattern is to allow matting or paper or other materials to be glued or attached to each side of the crenellation so that the edge is trimmed (similar to matting). As a result, the crenellation pattern allows that paper to be attached to itself and the flap providing greater adhesion to both the flap and the front/back paper to each other. The crenellation pattern 348 may be defined as peaks and troughs of rectangular sections that resemble a rectangular oscillating wave. This pattern extends along the entirety of each of the flaps 342.

Figure 36:
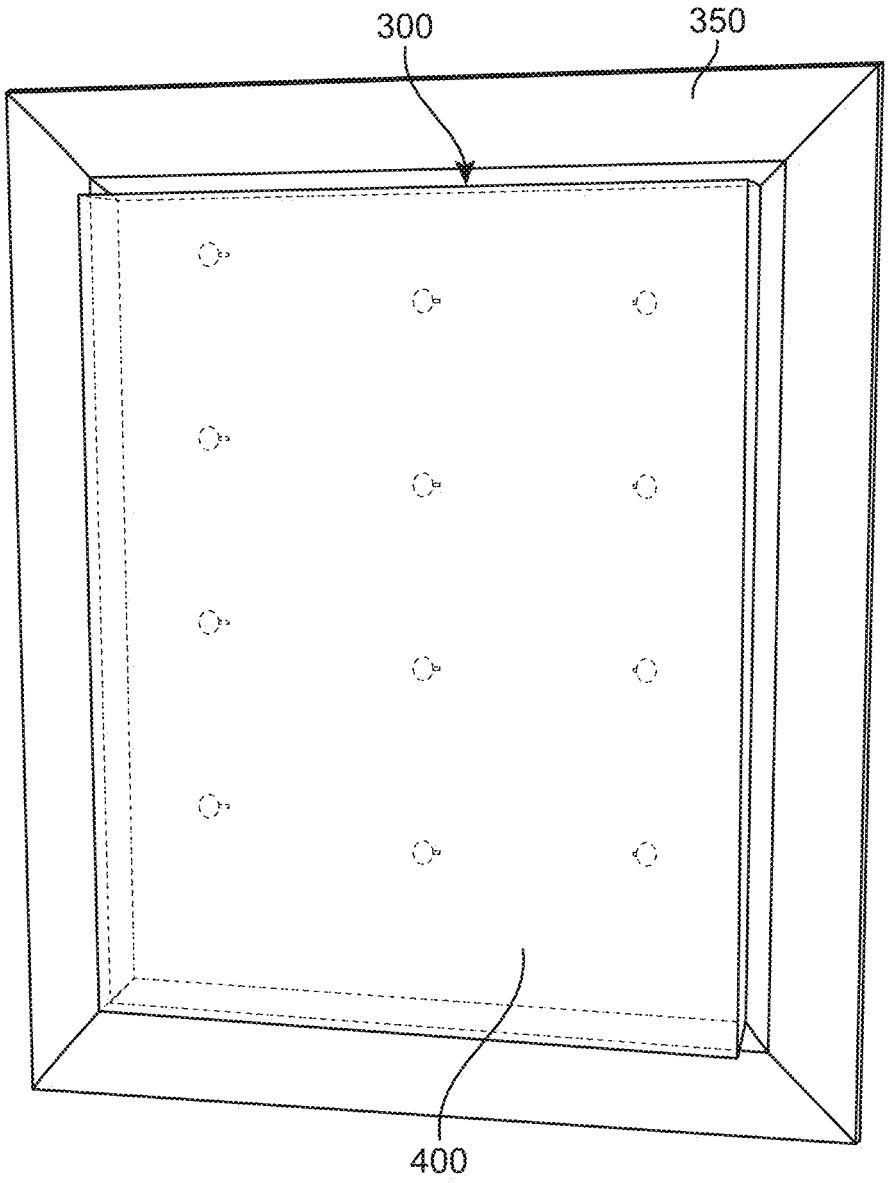
FIG. 36 illustrates an isometric view of frame 350 having a box frame insert 400 containing pin articles mounted thereon, additionally a framing system 300 is mounted to the frame 350 and over the box frame insert 400.

In one embodiment, framing system 300 further includes a box frame insert 400 which is utilized in conjunction with the framing system 300 and the frame 350. The box frame insert 400 includes an identical structure as described for the shadow box assembly 320 and the flap assembly 340. Additionally, the box frame insert has the same structure as depicted in FIGS. 30 and 31 of the provided drawings. However, in the present embodiment, the box frame insert 400 is made of a cardboard material or other suitable materials. Further, the box frame insert 400 includes sidewalls which have a height that is less than the height of sidewalls 324 that were provided for the box assembly 320. FIG. 36 depicts an implementation of the box frame insert 400 in accordance to one embodiment of the present invention. It can be observed that box frame insert 400 is inserted within the frame 350 and framing system 300 is further mounted to the frame 350 and over the box frame insert 400. In one implementation, a user may mount pins or artwork to the box frame insert 400 in order to aesthetically display the articles within the frame 350.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A framing system, comprising:

a) a frame having a top end and a rabbet;

b) a box assembly including a front face having at least four perimeter sides, said front face including sidewalls corresponding to each of said at least four perimeter sides, wherein said sidewalls include a proximal edge abutting with said at least four perimeter sides and a distal edge, said sidewalls are capable of being folded, the box assembly with foldable sidewalls define a box configuration, said box configuration having sharp edges; and c) a flap assembly including a flap provided for each of said sidewalls, wherein said flap is attached to said distal edge of said sidewalls, wherein said flap includes a width greater than a width of said distal edge, when said box assembly is in said box configuration each flap is folded outwardly from each sidewall defining an outer frame edge, when the outer frame edge is inserted within said rabbet the box assembly in said box configuration protrudes outwardly from a front of said frame, three-dimensional articles are positioned within said box assembly in said box configuration, said flap includes opposing end position each having a slit.

2. The framing system of claim 1 wherein said sidewalls extend above said top end of said frame.

3. The framing system of claim 1 wherein said flap includes end portions each having slanted edges.

4. The framing system of claim 1 wherein said flap includes an outer edge with a crenellation pattern, said crenellation pattern is provided in the form of rectangular oscillating waves.

5. The framing system of claim 1 wherein said sidewalls each has a trapezoidal shape.

6. The framing system of claim 1 further including a box frame insert mounted to said frame, said framing system mounted over said box frame insert when mounted to said frame.

7. The framing system of claim 1 wherein said sidewalls are positioned with an up to a 90-degree angle with respect to said front face.

8. The framing system of claim 1 wherein said flap is positioned with at least a 90-degree angle with respect to said sidewalls, said flap is positioned outwardly from said sidewalls.

9. The framing system of claim 1 wherein said slit of said flap is received by an adjacent flap, said adjacent flap having an adjacent slit that receives said slit.

* * * * *